United States Patent [19]

Nakada et al.

[11] 4,218,948

[45] Aug. 26, 1980

[54] ELECTRONIC MUSICAL INSTRUMENT OF KEY CODE PROCESSING TYPE

[75] Inventors: Akira Nakada; Eiichiro Aoki; Akiyoshi Oya; Takatoshi Okumura; Yasuji Uchiyama; Eiichi Yamaga, all of Hamamatsu, Japan

[73] Assignee: Nippon Gakki Seizo Kabushiki Kaisha, Hamamatsu, Japan

[21] Appl. No.: 972,031

[22] Filed: Dec. 21, 1978

[30] Foreign Application Priority Data

Dec. 27, 1977 [JP] Japan ..... 52-158217

[51] Int. Cl.[2] ..... G10H 1/00; G10H 5/00

[52] U.S. Cl. ..... 84/1.01; 84/DIG. 2; 84/DIG. 20

[58] Field of Search ..... 84/1.01, DIG. 2, DIG. 20

[56] References Cited

U.S. PATENT DOCUMENTS

| | | | |
|---|---|---|---|
| 3,743,755 | 7/1973 | Watson | 84/1.01 |
| 4,074,233 | 2/1978 | Swain | 84/1.01 X |
| 4,077,293 | 3/1978 | Uchiyama | 84/1.01 |
| 4,122,744 | 10/1978 | Uetrecht | 84/DIG. 2 |
| 4,138,916 | 2/1979 | Kitagawa | 84/1.01 |
| 4,141,268 | 2/1979 | Kugisawa | 84/1.01 X |
| 4,170,160 | 10/1979 | Guo | 84/1.01 |
| 4,170,768 | 10/1979 | Kitagawa | 84/1.01 X |

*Primary Examiner*—S. J. Witkowski

*Attorney, Agent, or Firm*—Spensley, Horn, Jubas & Lubitz

[57] ABSTRACT

An electronic musical instrument of a key code processing type includes a single tone generating section for producing a solo performance effect without providing a solo performance keyboard. This single tone generating section comprises a single data selection circuit which selects the highest (or lowest) note from among notes of depressed keys for producing a single musical tone. The single data selection circuit includes first and second memories and a comparison circuit. An input key code A is compared with a key code X stored in the second memory and the input key code A is stored in the first memory if the value of the input key code A is greater than the value of the key code X. When one cycle of the above described comparison has been completed, the data stored in the second memory is rewritten with the data of the first memory. The key code for the highest note is now stored in the second memory to designate a tone signal to be produced for a solo performance.

12 Claims, 12 Drawing Figures

FIG. 2

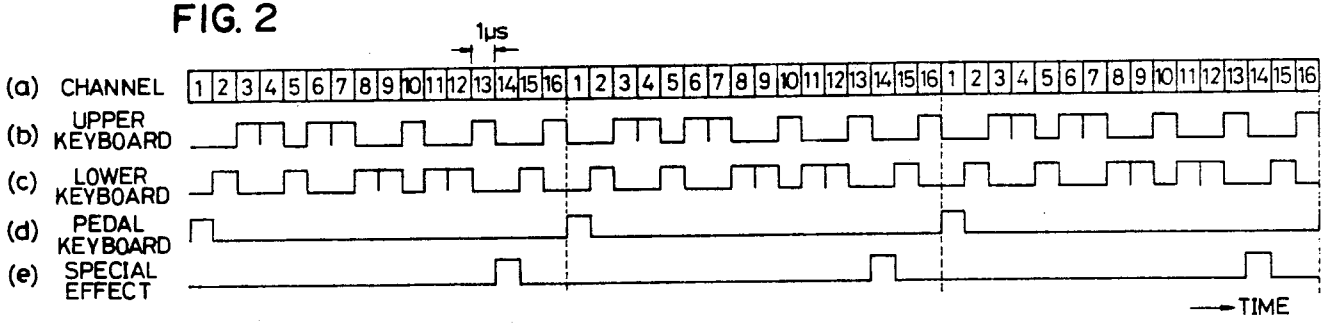

FIG. 3

| TIME SLOT | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 |
|---|---|---|---|---|---|---|---|---|---|---|---|---|---|---|---|---|---|---|---|---|---|---|---|---|
| $KC_1$ | "1" | $B_1$ | $N_1$ | | $B_1$ | $N_1$ | | $B_1$ | $N_1$ | | $B_1$ | $N_1$ | | $B_1$ | $N_1$ | | $B_1$ | $N_1$ | | $B_1$ | $N_1$ | | $B_1$ | $N_1$ |
| $KC_2$ | "1" | $B_2$ | $N_2$ | | $B_2$ | $N_2$ | | $B_2$ | $N_2$ | | $B_2$ | $N_2$ | | $B_2$ | $N_2$ | | $B_2$ | $N_2$ | | $B_2$ | $N_2$ | | $B_2$ | $N_2$ |
| $KC_3$ | "1" | $B_3$ | $N_3$ | | $B_3$ | $N_3$ | | $B_3$ | $N_3$ | | $B_3$ | $N_3$ | | $B_3$ | $N_3$ | | $B_3$ | $N_3$ | | $B_3$ | $N_3$ | | $B_3$ | $N_3$ |
| $KC_4$ | "1" | $KO_1$ | $N_4$ | | $KO_1$ | $N_4$ | | $KO_1$ | $N_4$ | | $KO_1$ | $N_4$ | | $KO_1$ | $N_4$ | | $KO_1$ | $N_4$ | | $KO_1$ | $N_4$ | | $KO_1$ | $N_4$ |
| KEYBOARD | | P | | | U | | | U | | | U | | | U | | | U | | | U | | | U | |
| CHANNEL | | 1 | | | 4 | | | 7 | | | 10 | | | 13 | | | 16 | | | 3 | | | 6 | |

| TIME SLOT | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 |
|---|---|---|---|---|---|---|---|---|---|---|---|---|---|---|---|---|---|---|---|---|---|---|---|---|
| $KC_1$ | | $B_1$ | $N_1$ | | $B_1$ | $N_1$ | | $B_1$ | $N_1$ | | $B_1$ | $N_1$ | | $B_1$ | $N_1$ | | $B_1$ | $N_1$ | | $B_1$ | $N_1$ | | $B_1$ | $N_1$ |
| $KC_2$ | | $B_2$ | $N_2$ | | $B_2$ | $N_2$ | | $B_2$ | $N_2$ | | $B_2$ | $N_2$ | | $B_2$ | $N_2$ | | $B_2$ | $N_2$ | | $B_2$ | $N_2$ | | $B_2$ | $N_2$ |
| $KC_3$ | | $B_3$ | $N_3$ | | $B_3$ | $N_3$ | | $B_3$ | $N_3$ | | $B_3$ | $N_3$ | | $B_3$ | $N_3$ | | $B_3$ | $N_3$ | | $B_3$ | $N_3$ | | $B_3$ | $N_3$ |
| $KC_4$ | | $KO_1$ | $N_4$ | | $KO_1$ | $N_4$ | | $KO_1$ | $N_4$ | | $KO_1$ | $N_4$ | | $KO_1$ | $N_4$ | | $KO_1$ | $N_4$ | | $KO_1$ | $N_4$ | | | $N_4$ |
| KEYBOARD | | L | | | L | | | L | | | L | | | L | | | L | | | L | | | ARP | |
| CHANNEL | | 9 | | | 12 | | | 15 | | | 2 | | | 5 | | | 8 | | | 11 | | | 14 | |

FIG. 9 (a) EXAMPLE 1

FIG. 9 (b) EXAMPLE 2

FIG. 9 (c) EXAMPLE 3

ELECTRONIC MUSICAL INSTRUMENT OF KEY CODE PROCESSING TYPE

BACKGROUND AND SUMMARY OF THE INVENTION

This invention relates to electronic musical instruments, and, more particularly, to an electronic musical instrument of a key code processing type in which a signal concerning the highest note (or the lowest note) is selected out of key operating signals supplied in time division manner, thereby to produce the musical tone of the highest note (or the lowest note) thus selected.

Some high grade electronic musical instruments have a solo keyboard in addition to ordinary upper, lower and pedal keyboards. Of course, with such a high grade electronic musical instrument, a plurality of keys can be operated simultaneously in the upper keyboard or the lower keyboard. Usually a solo performance can be effected by operating a single key in the solo keyboard while operating a plurality of keys in the upper or lower keyboard. However, since the provision of the solo keyboard is required for such a solo performance, the keyboard assembly of the electronic musical instrument is necessarily bulky, which results in an increase of the manufacturing cost. Thus, in general, such a solo keyboard is employed only for the highest grade electronic musical instrument.

Accordingly, an object of this invention is to provide an electronic musical instrument in which the same performance effect as a solo performance on a separate keyboard can be obtained without a solo keyboard.

In the electronic musical instrument according to the invention, a single key (corresponding to the highest note or the lowest note) is selected out of a plurality of keys depressed in a keyboard and the musical tone of the single key thus selected is produced, whereby the same performance effect as a solo performance effect is automatically obtained. In this case, the musical tones of the plurality of keys depressed are, of course, produced together with the musical tone of the selected single key.

It is well known in the art to employ a priority connection circuit, in which key switches are connected in a priority connection manner, in order to select a single key out of a plurality of keys. However, the employment of such a priority circuit is not preferable because the use of the priority circuit makes the keyboard circuit intricate and makes the arrangement of circuits relating to the keyboard bulky. Means for effectively simplifying the keyboard circuit and the circuitry concerning the keyboard circuit is to process key data in time division manner. An electronic musical instrument employing this time division process technique is known in the art.

This invention is intended to achieve the aforementioned object with the electronic musical instrument employing the time division process system. According to the invention, a single data selecting circuit is provided, which can select the key data of the highest note or the lowest note out of key data supplied in time division manner, so that a musical tone is produced according to the single key data thus selected.

BRIEF DESCRIPTION OF THE DRAWINGS

In the accompanying drawings:

FIG. 2 is a timing chart indicating time division tone production channel formed in a channel assigning circuit in FIG. 1;

FIG. 3 is a diagram showing the assignment of a note code $N_1$–$N_4$, a block code $B_1$–$B_3$ and a key-on signal $KO_1$ of a data $KC_1$–$KC_4$ to the times slots in one cycle, the data $KC_1$–$KC_4$ being supplied in time division manner from a data multiplexing circuit in FIG. 1 to a solo performance tone generator section in an automatic solo performance device and to other ordinary tone generators;

DETAILED DESCRIPTION OF THE INVENTION

One preferred embodiment of this invention will be described with reference to the accompanying drawings.

1. Description of the Entire Arrangement of the Embodiment

Figure 1:
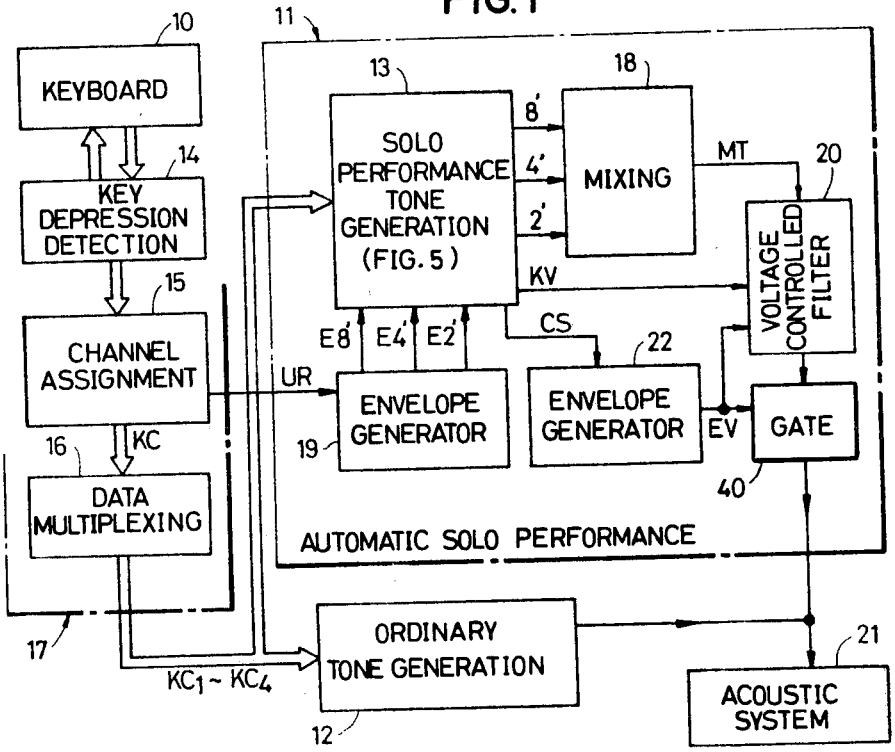
FIG. 1 is a block diagram showing one example of an electronic musical instrument according to this invention.
Figure 5:
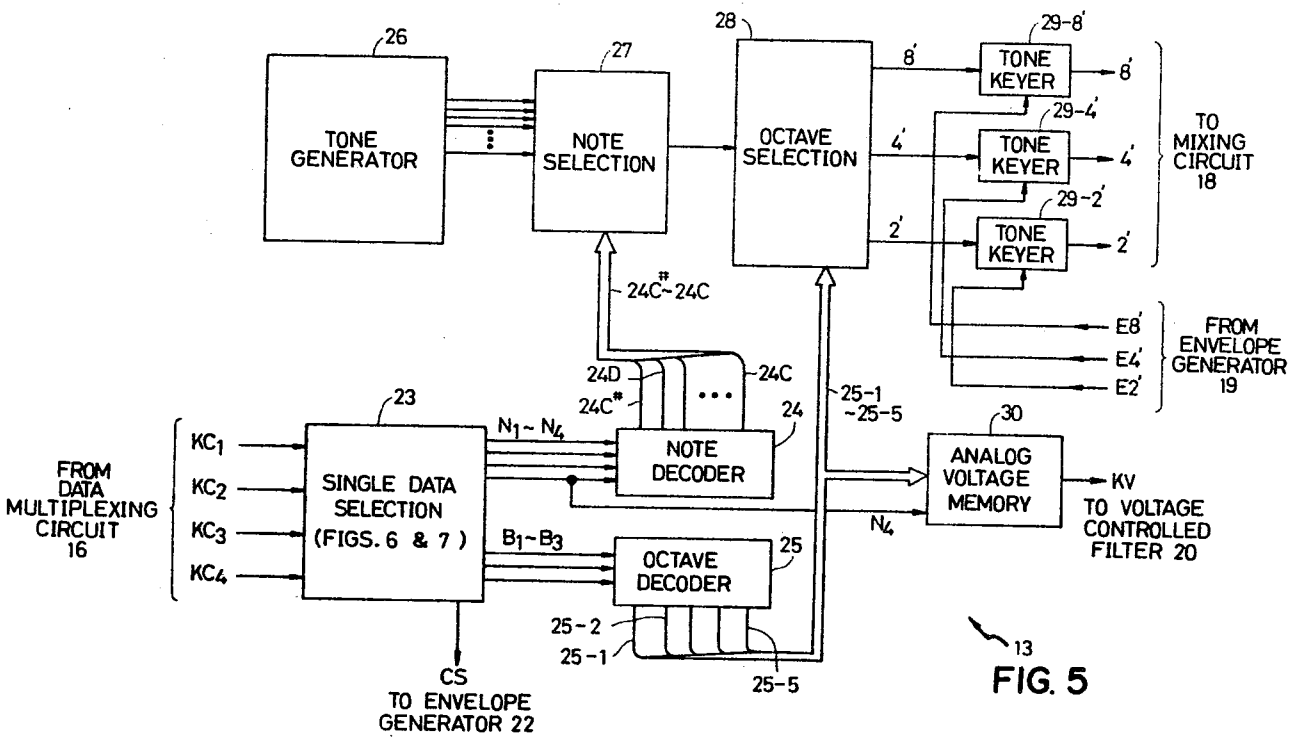
FIG. 5 is a block diagram showing one example of a solo performance tone generator section shown in FIG. 1.

In FIG. 1, a keyboard section 10 comprises an upper keyboard, a lower keyboard and a pedal keyboard. In this embodiment, a solo performance effect according to this invention can be obtained by using the upper keyboard. An automatic solo performance device 11 operates to provide the solo performance effect according to the invention, in which only one note highest in tone pitch (or lowest in tone pitch) among the note of the keys depressed in the upper keyboard is selected so that the tone is produced. The essential parts of this invention are included especially in a solo performance tone generator section 13 in the automatic solo performance device 11. The solo performance tone generator section 13 is illustrated in FIG. 5 in detail. The automatic solo performance device 11 is provided in parallel with an ordinary tone generator section 12. This tone generator section 12 operates to generate the tones of the keys depressed in the keyboard section 10 in a known manner, and it is so designed that the tones of keys depressed in the upper keyboard, the lower keyboard and the pedal keyboard are generated, respectively. This will be described in detail later.

A key depression detecting circuit 14 operates to detect the keys depressed in the keyboard section 10 and to supply informations representative of the depressed keys to a channel assigner circuit 15. This channel assigner circuit 15 is to assign the tone productions of the depressed keys to respective ones of tone production channels the number of which is predetermined. The number of tone production channels is, for instance, sixteen (16): the number of upper keyboard tone exclusive channels is seven (7), the number of lower keyboard tone exclusive channels is seven (7), the number of pedal keyboard tone exclusive channels is one (1), and the number of channels provided exclusively for special effects such as for instance automatic arpeggio performance (not the solo performance effect of this invention) is one (1). In the channel assigner circuit 15, tone production channel processing times are formed in time division manner. The relations of the channel times are indicated in the part (a) of FIG. 2, in which numerals indicated in time slots designates the respective channels. The part (b) of FIG. 2 shows seven (7) upper keyboard exclusive time slots; the part (c) of FIG. 2, seven lower keyboard exclusive time slots; the part (d) of FIG. 2, one pedal keyboard exclusive time slot; and the part (e) of FIG. 2, one special effect exclusive time slot. Key codes KC representative of depressed keys assigned to the channels are delivered out of the channel assigner circuit 15 in time division manner according to the channel times shown in the part (a) of FIG. 2. A key code KC consists of a 4-bit note code $N_1$, $N_2$, $N_3$, $N_4$ for distinguishing twelve notes from one another and a 3-bit block code $B_1$, $B_2$, $B_3$ for identifying an octave range to which the note thus distinguished belongs. A key-on signal $KO_1$ representing whether a key assigned to the respective channel is being depressed ("1") or released ("0") is outputted in time division manner by the channel assigner circuit 15, and various control data (not described) is outputted by the channel assigner circuit 15 as required.

The key code KC, the key-on signal $KO_1$ and other control data are supplied to a data multiplexing circuit 16, where they are multiplexed into a 4-bit data $KC_1$, $KC_2$, $KC_3$, $KC_4$ in order to reduce the number of connections between an integrated circuit chip 17 including the channel assigner circuit 17 and another integrated circuit chip including the tone generator section 12. The data multiplexing circuit 16 delivers out a reference data for determining time slots where the key data of the channels exist before it multiplexes the key data and delivers out them. The reference data is one in which all of the bits in the data $KC_1$, $KC_2$, $KC_3$, $KC_4$ are at "1".

The number of time slots for the multiplexed data $KC_1$–$KC_4$ outputted by the data multiplexing circuit 16 is forty-eight (48). The states of the data $KC_1$–$KC_4$ in the time slots "1" through "48" are as indicated in FIG. 3, with the time slot of the reference data "1 1 1 1" being the time slot "1". In the column "KEYBOARD", reference characters "U" designates the channels to which the upper keyboard notes are exclusively assigned; reference character "L" designates the channel to which the lower keyboard notes are exclusively assigned; reference character "p" designates the channel to which the pedal keyboard notes are exclusively assigned; and reference character "ARP" designates the channel to which the notes for special effects such as for instance automatic arpeggio effects are exclusively assigned. In the column "CHANNEL", reference numerals designate the channels to which the key code, etc. $N_1$–$N_4$, $B_1$–$B_3$ and $KO_1$ are assigned. The time slots "1" through "48" occur repeatedly.

As is apparent from FIG. 3, with respect to the multiplexed data $KC_1$–$KC_4$, three time slots are provided for one tone production channel. If it is assumed that one time slot is one bit time, then the channel of the data $KC_1$–$KC_4$ is switched every three bit times. No data are provided in the time slots "4", "7", "10" - - - "46" which are the first time slots of the respective channels, but these time slots are used for transmitting the control data (through they are not shown because they are not particularly related to this invention).

The block code $B_1$–$B_3$ is assigned to the data $KC_1$–$KC_3$, and the key-on signal $KO_1$ is assigned to the data $KC_4$. The note code $N_1$–$N_4$ is assigned to the data $KC_1$–$KC_4$. In one and same channel (one and same key), the block code $B_1$–$B_3$ and the key-on signal $KO_1$ are assigned to a time slot ("2", "5", "8" - - - "47") immediately before the time slot of the note code $N_1$–$N_4$. That is, the block code $B_1$–$B_3$ and th key-on signal $KO_1$ of each channel occurs in the data $KC_1$–$KC_4$ every three bit times. As the note code $N_1$–$N_4$ is assigned to the time slots "3", "6" - - - "48", it occurs in the data $KC_1$–$KC_4$ every three bit times.

An electronic musical instrument employing the data multiplexing circuit 16 as described above is described in detail in the specification of U.S. patent application Ser. No. 929,007, filed July 28, 1978, and assigned to the same assignee as this case; however, its detailed description is omitted in the present specification because it is not essential in the present invention.

The relations between the contents of the note code $N_1$–$N_4$ and twelve notes C#–C are indicated in Table 1 below:

Table 1

| Note | $N_4$ | $N_3$ | $N_2$ | $N_1$ | Number in decimal notation |
|---|---|---|---|---|---|
| C# | 0 | 0 | 0 | 1 | 1 |
| D | 0 | 0 | 1 | 0 | 2 |
| D# | 0 | 0 | 1 | 1 | 3 |
| E | 0 | 1 | 0 | 1 | 5 |
| F | 0 | 1 | 1 | 0 | 6 |
| F# | 0 | 1 | 1 | 1 | 7 |
| G | 1 | 0 | 0 | 1 | 9 |
| G# | 1 | 0 | 1 | 0 | 10 |
| A | 1 | 0 | 1 | 1 | 11 |
| A# | 1 | 1 | 0 | 1 | 13 |
| B | 1 | 1 | 1 | 0 | 14 |
| C | 1 | 1 | 1(0) | 1(0) | 15 |

The weights of the bits of the note code $N_1$–$N_4$ are such that the bit $N_1$ is the least significant bit and the bit $N_4$ is the most significant bit. The order in value of the note codes $N_1$–$N_4$ corresponds to the order in tone pitch of the notes C#–C, the note C# being the lowest tone, the note C being the highest tone. The value for the note C is changed from "1 1 1 1" to "1 1 0 0" in the data multiplexing circuit 16, so that it may not be mistaken as the reference data "1 1 1 1" when delivered in the form of data $KC_1$–$KC_4$ (cf. the time slot "1" in FIG. 3). But the signal "1100" is converted back to "1111" in the single data selection circuit described later.

The relations between the contents of the block code $B_1$–$B_3$ and the octave ranges are as indicated in Table 2 below:

Table 2

| $B_3$ | $B_2$ | $B_1$ | Octave Range | |
|---|---|---|---|---|
| 0 | 0 | 0 | C#2–C3 | First Octave |
| 0 | 0 | 1 | C#3–C4 | Second Octave |
| 0 | 1 | 0 | C#4–C5 | Third Octave |
| 0 | 1 | 1 | C#5–C6 | Fourth Octave |
| 1 | 0 | 0 | C#6–C7 | Fifth Octave |

The bit $B_1$ is the least significant bit, and the bit $B_3$ is the most significant bit. Thus, the order in value of the block codes $B_1$–$B_3$ corresponds to the order of the octave ranges.

It can be understood from that above description that in the multiplexed data $KC_1$–$KC_4$, the data $KC_1$ is the least significant bit and the data $K_4$ is the most significant bit.

In the ordinary tone generator section 12, the note codes $N_1$–$N_4$, the block codes $B_1$–$B_3$ and the key-on signal $KO_1$ supplied thereto by the data multiplexing circuit 16 are picked up separately according to the channels, and in accordance with these key data, musical tones are produced separately according to the channels.

The data $KC_1$–$KC_4$ from the data multiplexing circuit 16 is applied to the solo performance tone generator section 13 in the automatic solo performance device 11. In this solo performance tone generator section 13, first only the key data $N_1$–$N_4$, $B_1$–$B_3$ and $KO_1$ of the upper keyboard exclusive channels are selected out of the data $KC_1$–$KC_4$ supplied thereto in time division manner, and then the key data concerning the key of the highest (or lowest) note is selected out of the key data of the upper keyboard exclusive channels thus selected, so that tone signals corresponding to the single key data thus selected is produced. In this case, three tone signals of 8-foot register (8′), 4-foot register (4′) and 2-foot register (2′) different in pitch (by an octave) are produced in a parallel mode. In this example, the tone signal of each footage (8′, 4′ and 2′) produced by the tone generator section 13 is a square wave of a duty ratio ½, and a mixed tone signal MT outputted by mixing circuit 18 is a waveform having a number of harmonic components.

Figure 4:
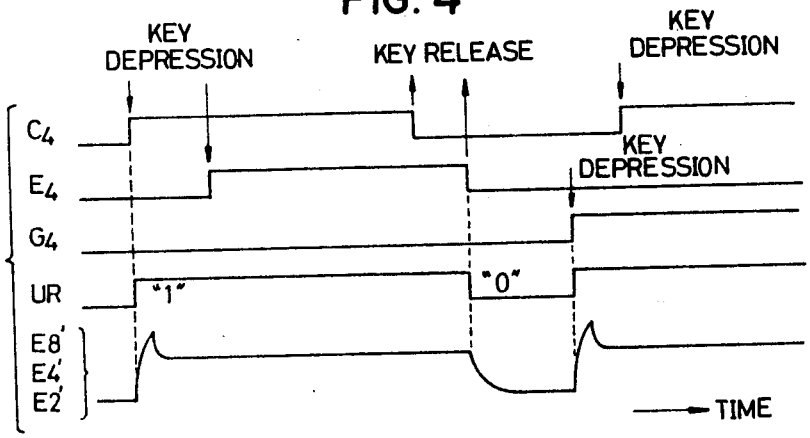
FIG. 4 is a timing chart indicating one example of the generation of an upper keyboard key-on signal UR supplied from the channel assigning circuit to an envelope generator (19) in FIG. 1 and one example of envelope waveform voltage signals E8', E4' and E2' produced in response to the upper keyboard key-on signal UR.

Incidentially, an upper keyboard key-on signal UR is applied to an envelope generator 19 in the automatic solo performance device 11 from the channel assigner circuit 15 described above. This upper keyboard key-on signal UR is maintained at "1" as long as a key in the upper keyboard is depressed, and it is at "0" where no key is depressed in the upper keyboard. FIG. 4 shows the generation of the upper keyboard key-on signal UR with reference to the case where three keys $C_4$, $E_4$ and $G_4$ are operated (depressed or released) in the upper keyboard. The envelope generator 19 operates to provide envelope shape voltage signals E8′, E4′ and E2′ in response to the upper keyboard key-on signal UR (cf. FIG. 4). The envelope shape voltage signals E8′, E4′, and E2′ are applied to the solo performance tone generator section 13, where they are used to control the amplitude envelopes of square wave tone signals (8′, 4′ and 2′) of the respective footage outputted by the tone generator section 13.

The mixed tone signal MT outputted by the mixing circuit 18 is applied to a voltage-controlled filter 20, where its harmonic components are controlled for tone coloring. A musical tone signal (solo performance effect tone) which has been subjected to tone color control is applied from the voltage controlled filter 20 to an acoustic system 21 (through an analog gate 40 if necessary), where it is produced as a tone.

Ordinary musical tone signals corresponding to depressed keys, which are outputted by the ordinary tone generator section 12, are also produced as tones by the acoustic system 21. Another envelope generator 22 in the automatic solo performance device 11 will be described later.

I Description of the Solo Performance Tone Generator Section 13

In the solo performance tone generator section 13 shown in FIG. 5, the time division multiplexed data $KC_1$–$KC_4$ supplied by the data multiplexing circuit 16 is applied to a single data selecting circuit 23 which operates to select the key data $N_1$–$N_4$, $B_1$–$B_3$ and $KO_1$ of the highest note out of the notes assigned to the upper keyboard exclusive channels among the data $KC_1$–$KC_4$ supplied thereto in time division manner. Among the key data of the highest note thus selected, the note code $N_1$–$N_4$ is applied to a note decoder 24, as a result of which a signal "1" is provided on one decode input line (one of the decode output lines 24C#–24C) corresponding to the note. On the other hand, among the key data of the highest note thus selected, the block code $B_1$–$B_3$ is supplied to an octave decoder 25, as a result of which a signal "1" is provided on one decode output line (out of the decode output lines 25-1 through 25-5) corresponding to the octave range thereof. The single data selecting circuit 23 outputs a solo effect tone switching signal CS whenever the highest note is changed, as described later.

This solo effect tone switching signal CS is applied to the envelope generator 22 shown in FIG. 1. In response to the production of the solo effect tone switching signal CS, the envelope generator 22 outputs an envelope waveform voltage signal EV, which is applied to the control terminal of the voltage-controlled filter 20 to control its cut-off frequency in accordance with the relevant envelope shape. Thus, whenever the highest note (that is, the solo effect tone) selected by the single-data selecting circuit 23 is changed, the tone color is controlled at the rise of the highest tone. It goes without saying that other appropriate tone color controlling voltage (not shown) are applied to the the vl voltage controlled filter 20. The analog gate 40 (indicated by the broken line) may be inserted in the output path of the voltage controlled filter 20 so that the envelope shape voltage signal EV is applied to the control terminal of the analog gate 40 thereby to control the amplification factor according to the relevant envelope shape. This has a merit that the highest tone can be produced intermittently only when it is changed.

A tone generator 26 operates to generate square wave tone source signals having various tone pitches in accordance with a frequency division system. The output of the tone generator 26 is applied to a note selecting circuit 27, where the square wave tone source signal of a single note is selected in correspondence to the output of the note decoder 24 described before. The single tone source signal selected by the note selecting circuit 27 includes wave data for the same notes in a plurality of octave ranges. Among the plurality of octave ranges, a signal representing a necessary octave range is selected by an octave selecting circuit 28 to which the output of the octave decoder 25 is applied as the selection control signal of the octave selecting circuit 28. In the octave selecting circuit 28, three square wave tone signals of 8-foot register (8') 4-foot register (4) and 2-foot register (2') different in pitch are selected in a parallel mode according to one octave select data (the output of the decoder 25). The square wave tone signals (8', 4' and 2') of the respective footage thus selected correspond to the tone source signal of the highest tone selected by the single data selecting circuit 23. It is not always necessary to provide the frequency division type tone generator 26 exclusively for the solo performance tone generator 13; that is, the tone generator in the tone generator section 12 may be used commonly for the solo performance tone generator 13. Instead of the ordinary frequency division circuit, a multiplexed submultiple data generator circuit disclosed by the specification of the U.S. patent application Ser. No. 915,239 assigned to the same assignee as this case (filed June 13, 1978) may be employed as the tone generator 26. In this case, a single submultiple signal generator section described by the specification of the same application should be used for the octave selecting circuit 28.

The square wave tone source signal (8', 4' and 2') of the respective footage are applied to tone keyers 29-8', 29-4' and 29-2', respectively. The envelope shape voltage signals E8', E4' and E2' from the above-described envelope generator 19 are applied to the keying control terminals of the tone keyers 29-8' 29-4' and 29-2', respectively. The square wave tone signals (8', 4' and 2') subjected to tone keying control according to the envelope shape voltage signals E8', E4' and E2' are supplied to the mixing circuit 18.

An analog voltage memory 30 has stored tone pitch voltages having values corresponding to tone pitches. It should be noted that the analog voltage memory 30 does not store a tone pitch voltage for every note, that is, it stores tone pitch voltages for every half octave range. For this purpose, among the key data $N_1$–$N_4$, $B_1$–$B_3$ of the highest note outputted by the single data selecting circuit 23, the most significant bit $N_4$ of the note code $N_1$–$N_4$ and the block code $B_1$–$B_3$ are employed as an address specifying signal of the analog voltage memory 30. As is apparent from Table 1, the bit $N_4$ is set to "1" or "0" every half octave. Therefore, it is possible to identify with the block code $B_1$–$B_3$ and the bit $N_4$ a half octave to which the highest note belongs. In FIG. 5, after being decoded by the octave decoder 25, the block code $B_1$–$B_3$ is applied to the analog voltage memory 30. A tone pitch voltage KV corresponding to the half octave to which the highest note selected by the single data selecting circuit 23 is read out of the analog voltage memory. The tone pitch voltage KV thus read is applied to the control voltage input terminal of the voltage controlled filter 20 (FIG. 1). This tone pitch voltage KV is to vary the cut-off frequency of the voltage controlled filter 20 in accordance with the octave range of the highest note (the tone signal MT) thereby to eliminate the variations of tone color due to the variations of octave range.

III Description of the Single Data Selecting Circuit 23

Figure 6:
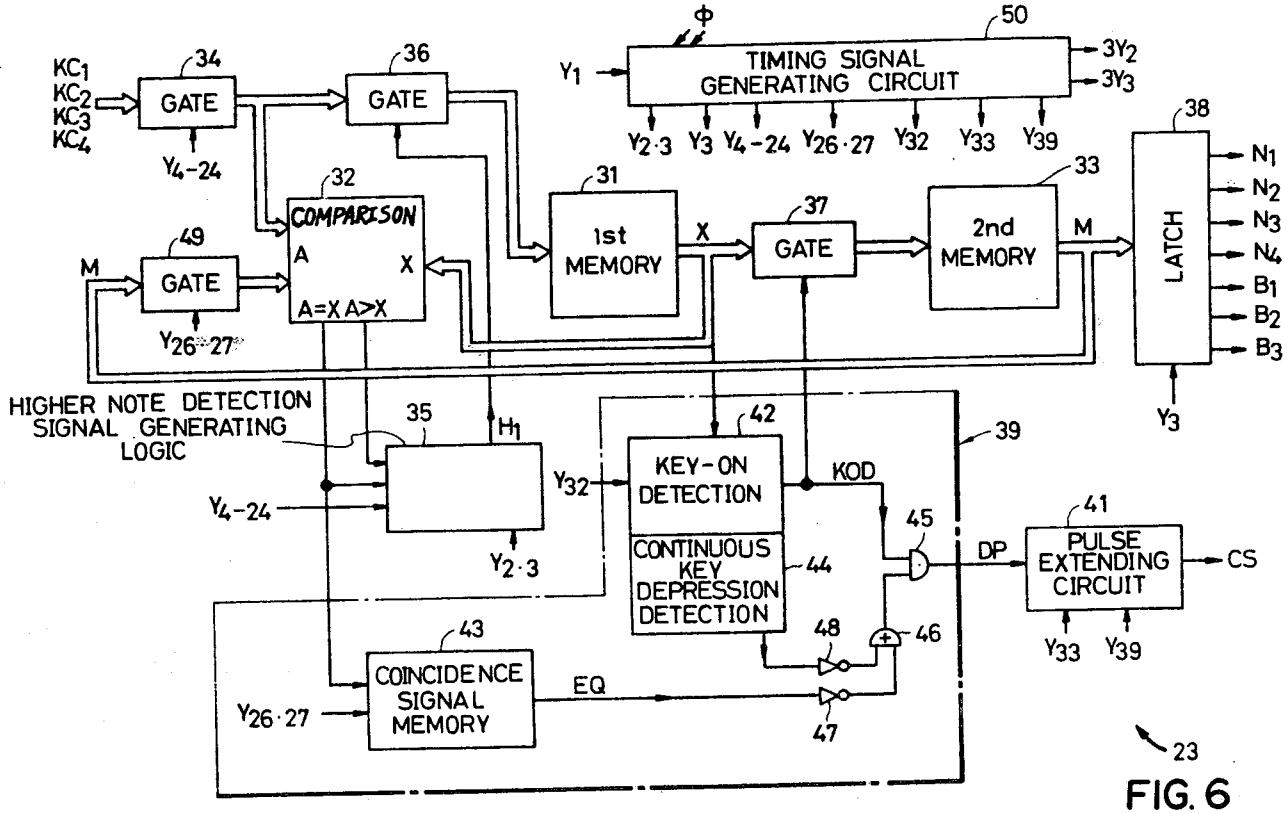
FIG. 6 is a block diagram showing one example of a single data selecting circuit shown in FIG. 5.
Figure 7:
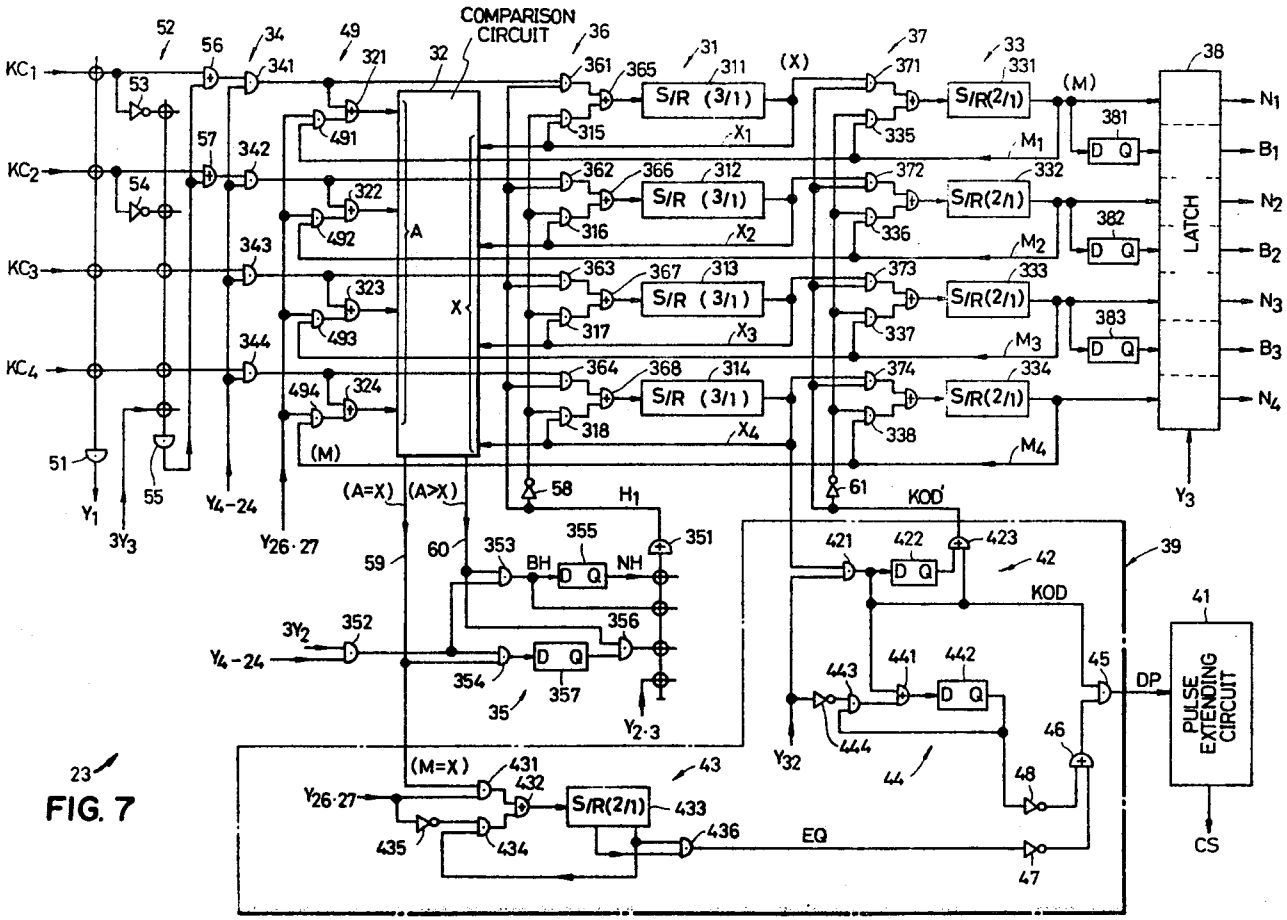
FIG. 7 is a detailed diagram of the single data selecting circuit shown in FIG. 6.

FIG. 6 is a block diagram showing one example of the single data selecting circuit 23, and FIG. 7 shows the circuit of FIG. 6 in more detail.

(1) Brief Description (FIG. 6)

The single data selecting circuit 23 comprises essentially a first memory circuit 31, a comparison circuit 32 and a second memory circuit 33. As is clear from Table 1 and Table 2, the values of the key data ($N_1$–$N_4$, $B_1$–$B_3$) correspond to the tone pitches of the notes, respectively. The weight of the block code $B_1$–$B_3$ is greater than that of the note code $N_1$ $N_4$. Accordingly, the single data selecting circuit 23 is so designed that, in order to select a key data ($N_1$–$N_4$ $B_1$–$B_3$) corresponding to a highest note among key data ($N_1$–$N_4$, $B_1$–$B_3$) supplied tin the form of data $KC_1$–$KC_4$ a key data having the maximum value is detected.

In the comparison circuit 32, a memory data X in the first memory circuit 31 is compared with a key data $N_1$–$N_4$, $B_1$–$B_3$ (multiplexed data $KC_1$–$KC_4$) supplied in time division manner. When the key data $N_1$–$N_4$, $B_1$–$B_3$ of a channel included in the multiplexed data $KC_1$–$KC_4$ is greater than the memory data X of the first memory circuit 31, the memory data X is rewritten into the key data $N_1$–$N_4$, $B_1$–$B_3$. Similarly, the key data $N_1$–$N_4$, $B_1$–$B_3$ which are successively supplied to the comparison circuit 32 are subjected to comparison, and when the key data is greater than the memory data, it is stored in the first memory circuit 31. Accordingly, when the key data of all the channels have been subjected to comparison, the key data ($N_1$–$N_4$, $B_1$–$B_3$) having the maximum value (the highest note) is stored in the the first memory circuit 31.

The multiplexed data $KC_1$–$KC_4$ supplied from the data multiplexing circuit 16 (FIG. 1) is applied to an upper keyboard selecting gate 34, and only the data $KC_1$–$KC_4$ (the key data $N_1$–$N_4$, $B_1$–$B_3$ $KO_1$) concerning the upper keyboard is selected. This is to detect the highest note of the upper keyboard in the single data selecting circuit 23. The key data $N_1$–$N_4$ $B_1$–$B_3$, $KO_1$ selected by the upper keyboard selecting gate 34 is applied to the comparison input terminal A of the comparison circuit 32.

A tone pitch detection signal generating logic 35 operates to generate a tone pitch detection signal $H_1$ when the comprison result of the comparison circuit 32 is $A > X$. The same signal as a signal Y4–24 for opening the upper keyboard selecting gate 34 is applied to the tone pitch detection signal generating logic 35. Only while the gate 34 is being opened, a gate 36 can be opened. When data $KC_1$–$KC_4$ is supplied through the opened gate 36 to the first memory circuit 31, its memory data X is rewritten into the data $KC_1$–$KC_4$; that is, the latter is stored in the first memory circuit 31.

In the second memory circuit 33, when one cycle of maximum value (highest note) detection operation has been achieved by utilizing the comparison circuit 32 and the first memory circuit 31, that is, when the truely maximum value data X has been stored in the first memory circuit 31, the memory data X of the first memory circuit 31 is applied thereto through a gate 37 and it is stored therein. In the first memory circuit 31, the contents of the memory data X is changed as the comparison detection operation is advanced. Accordingly, the second memory circuit 33 is so designed that the truly maximum value data is continuously stored therein.

A latch circuit 38 operates to latch the memory data M of the second memory circuit 33 according to a periodic timing signal Y3. The reason why the latch circuit 38 is that one key data is divided into two time slots in this example (the time slots for the data $B_1$–$B_3$ and the data $N_1$–$N_4$, and that as the maximum value data M is stored by the second memory circuit 33 with two time slots, it is necessary to convert it into parallel data.

The aforementioned solo effect tone switching signal GS is obtained by extending a highest note detection pulse DP outputted by a highest note detection control circuit 39 to a pulse having a predetermined time width by using a pulse extending circuit 41. The highest note detection control circuit 39 is so designed that in the highest note detection (in the solo effect tone generation) it can satisfy the following requirements;

Requirement 1:

When the highest note is changed by releasing one of the keys which have been depressed or by depressing another key additionally, the highest note detection pulse DP is produced.

Requirement 2:

When all the keys are released; that is, no key is depressed, this is not regarded as the highest note is changed, and no highest note detection pulse DP is outputted.

Requirement 3:

When among the keys which have been depressed, the keys other than the key of the highest note are released, the highest note is not changed. Therefore, the highest note detection pulse DP is not outputted.

Requirement 4:

When, after all the keys having been depressed are released, the key of the highest note is depressed again, the highest note detection pulse DP is provided although the highest notes is not changed.

In the highest note detection control circuit 39, according to the above-described requirements 1 through 4 the maximum value (highest note) data X stored in the first memory circuit 31 is evaluated, and according to this evaluation the highest note detection pulse DP is outputted and the gate 37 is opened to permit the memory data X in the first memory circuit 31 to be inputted into the second memory circuit 33. In the highest note detection circuit 39, a key-on detection circuit 42 essentially relates to the evaluation; that is, it relates to the decisions of the requirements 1 through 4. The key-on detection circuit 42 and a coincidence signal memory circuit 43 contribute to the decisions of the requirements 1 and 3; the key-on detection circuit 42 contributes to the decision of the requirement 2; and the key-on detection circuit 42 and a continuous key depression detection circuit 44 contribute to the decision of the requirement 4. The key-on detection circuit 42 outputs a key-on detection signal KOD, which is applied to an AND circuit 45. When a predetermined condition of the AND circuit 45 is satisfied, the signal KOD is outputted as the highest note detection pulse DP by the AND circuit 45. The outputs of the coincidence signal memory circuit 43 and the continuous key depression detection circuit 44 are applied through respective inverters 47 and 48 and an OR circuit 46 to the AND circuit 45 to control whether or not the key-on detection signal KOD should be outputted as the highest note detection pulse DP.

The key-on detection circuit 42 detects whether or not the maximum value data X stored in the first memory circuit 31 concerns a key which is depressed at the present time. This detection is carried out when one cycle of maximum value detection operation has been completed by using the comparison circuit 32 and the first memory circuit 31 according to a signal $Y_{32}$, i.e., when the truly maximum value data X is stored in the first memory circuit 31. In the case where the maximum value data X stored in the first memory circuit 31 concerns a key being depressed, the key-on detection signal KOD is outputted by the key-on detection circuit 42 to open the gate 37, whereupon the memory data X of the first memory circuit 31 is supplied to the second memory circuit 33, as a result of which the memory data in the memory circuit 33 is rewritten thereinto. That is, the key data ($N_1$–$N_4$, $B_1$–$B_3$) of the highest note among the notes of the keys being depressed is stored in the second memory circuit 33.

The key data $N_1$–$N_4$, $B_1$–$B_3$ (that is, the key data included in the data $KC_1$–$KC_4$) delivered by the channel assigner circuit 15 are not always limited to those of keys being depressed; that is, the key data include those of keys which were released but are in decay tone production state. Therefore, sometimes the key data concerning keys released may be stored in the first memory circuit 31. In such a case, the memory data X in the first memory circuit 31 is not regarded as the key data of the highest note, and the memory data in the second memory circuit 33 is not rewritten. Thus storing the key data of a key released, as the data of the highest note, in the first memory circuit 31 occurs when all the keys are released in the upper keyboard. In other words, as the weight of the key-on signal $KO_1$ is higher than that of the block code $B_1$–$B_3$; that is, the key-on signal is of the most significant bit as it apparent from the assignment of the multiplexed data $KC_1$–$KC_4$, process is effected by the comparison circuit 32 with the value of the key data of a key being depressed larger than that of the key data of a key released. Thus, storing the key data of a key released, as the maximum value, in the first memory circuit 31 may occur only when all the keys have been released. In this case, as the key-on detection signal KOD is not provided, the memory data in the second memory circuit 33 is not rewritten and the highest note detection pulse DP is not outputted. Thus, the above-described requirement 2 is satisfied.

The change of the highest note can be detected by subjecting the highest value memory data X of the first memory circuit and the highest value memory data M of the second memory circuit to comparison. For this purpose, the comparison circuit 32 is utilized. When one cycle of comparison between the memory data X in the first memory circuit 31 and the key data ($KC_1$–$KC_4$) of the channels supplied in time division manner has been achieved, a signal $Y_{26,27}$ is provided to open a gate 49. At the same time, the upper keyboard selecting gate 34 is closed, and supplying the multiplexed data $KC_1$–$KC_4$ to the comparison circuit 32 is suspended. Instead of this, the memory data M of the second memory circuit 33 is applied through the gate 49 to the input terminal A of the comparison circuit. The comparison circuit 32 supplies a coincidence signal to a coincidence signal memory circuit 43 when $A=X$. The coincidence signal memory circuit, being applied with the signal $Y_{26,27}$ stores and outputs the coincidence signal EQ when the coincidence is detected by the comparison circuit 32 with the gate 49 open. Upon provision of the coincidence signal EQ, the condition of the AND circuit 45 is not satisfied, and therefore the highest note detection pulse DP is not outputted, because the highest note is not changed. When the highest note is changed, $M \neq X$, and therefore the coincidence signal EQ is not outputted, and the highest note detection pulse DP is produced. Thus, the above-described requirements 1 and 3 are satisfied.

The continuous key depression detection circit 44 operates to output a signal "1" as long as a key is depressed in the upper keyboard and to output a signal "0" when all the keys which has been depressed are released. When, after all the keys which have been depressed are released, the key of the highest note is depressed again M=X and the coincidence signal EQ is produced. However, this will not satisfy the requirement 4. To satisfy the requirement 4, the continuous key depression detection circuit 44 has been provided. Thus, when all the keys have been released, the output of the continuous key depression detection circuit 44 is set to "0". The signal "0" is applied through the inverter 48 and the OR circuit 46 to the AND circuit 45 to enable the latter 45. If under this condition the key of the highest note which was depressed before is depressed again, the key-on detection signal KOD is produced, the condition of the AND circuit 45 is satisfied with the output "0" of the continuous key depression detection circuit 44, and the highest note detection pulse DP is provided. In this connection, it should be noted that the output of the continuous key depression detection circuit 44 is raised to "1" slightly later than the generation timing the key-on detection signal KOD. Thus, the aforementioned requirement 4 is satisfied.

A timing signal generating circuit 50 operates to generate periodic timing signals $Y_{2.3}$, $Y_3$, $Y_{4\text{-}24}$, $Y_{26.27}$, $Y_{32}$ - - - to control the operation of the single data selecting circuit 23. The relation in time of these timing signals will be described with reference to FIG. 8.

Figure 8:
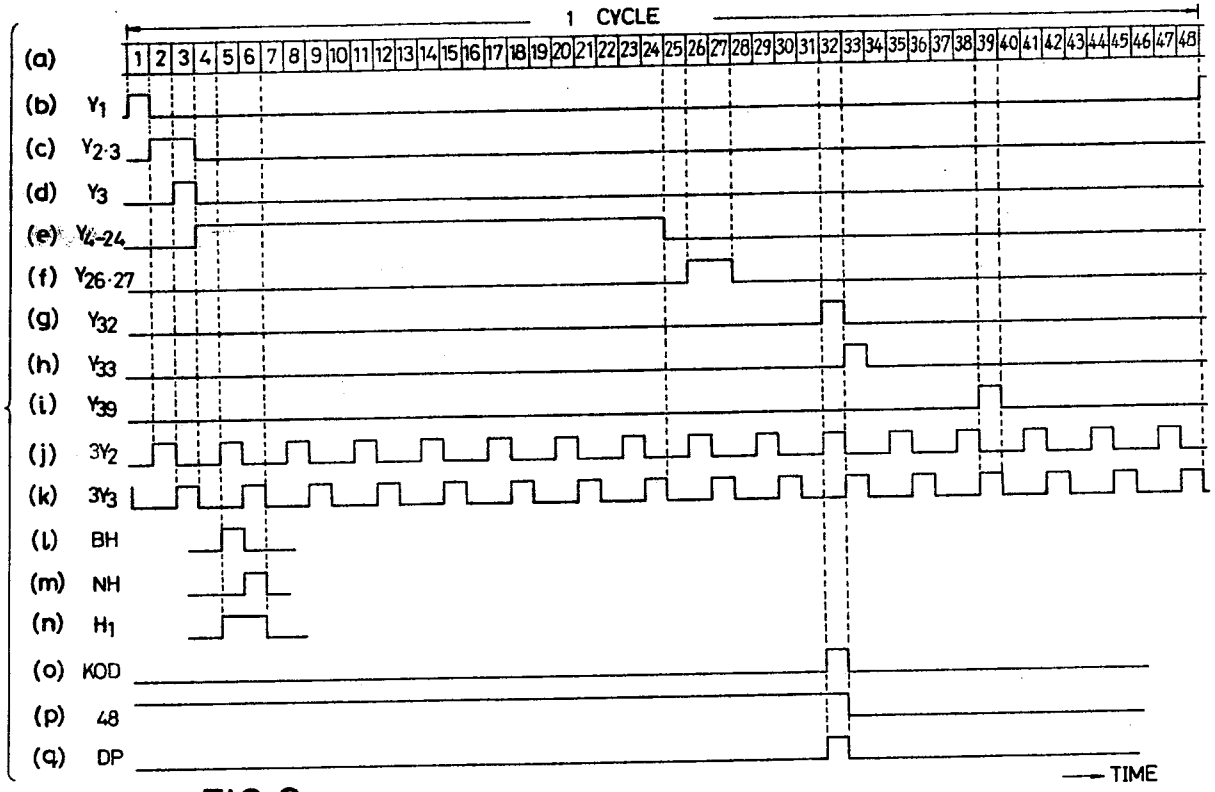
FIG. 8 is a timing chart indicating the generation of various timing signals shown in FIGS. 6 and 7, and for a description of the operation of the circuitry shown in FIG. 7 which is controlled by these timing signals.

The part (a) of FIG. 8 is similar to the time slots "1" through "48" of the multiplexed data $KC_1$–$KC_4$ shown in FIG. 3. The signals $Y_{2.3}$, $Y_3$, $Y_{4\text{-}24}$, - - - synchronous with the time slot of the data $KC_1$–$KC_4$. The signal $Y_1$ (FIG. 8, (b)) generated in the time slot "1" is obtained by detecting the reference data "1 1 1 1" (cf. FIG. 3) included in the data $KC_1$–$KC_4$. In the timing signal generating circuit 50, this signal $Y_1$ is shifted according to a clock pulse $\phi$ to generate the various timing signals $Y_{2.3}$, $Y_3$, $Y_{4\text{-}24}$, - - - . The clock pulse $\phi$ is a 2-phase clock pulse havng a period of one bit time (for instance 1 $\mu$s). The suffix numerals of the timing signals $Y_{2,3}$, $Y_3$, $Y_{4\text{-}24}$ designate the time slots in which they are generated, respectively. That is, the signal $Y_{2.3}$ is generated in the time slots "2" and "3" (FIG. 8, (c)), the signal $Y_3$ is generated in the time slot "3" (FIG. 8, (d)), and signal $Y_{4\text{-}24}$ is generated for the time from the time slot "4" through the time slot "24" that is, the signal $Y_{4\text{-}24}$ is generated for the period of time during which the key data of the upper keyboard exclusive channels are delivered, as is apparent from FIG. 3. Similarly, the timing signals $Y_{26.27}$, $Y_{32}$, $Y_{33}$ and $Y_{39}$ are generated as indicated in the parts (f), (g), (h) and (i) of FIG. 8, respectively. The generation period of each of the signals $Y_{2.3}$ through $Y_{39}$ shown in the part (c) through (i) is 48 bit times. A signal $3Y_2$ shown in the part (j) of FIG. 8 is signal which is generated with a period of three bit times starting with the time slot "2". As is clear from FIG. 3, the signal $3Y_2$ is synchronous with the time slots "2", "5", "8" - - - in which the block code $B_1$–$B_3$ and the key-on signal $KO_1$ are delivered as the data $KC_1$–$KC_4$. A signal $3Y_3$ shown in the part (k) of FIG. 8 is a signal which is generated with a period of three bit times starting with the time slot "3". As is apparent from the FIG. 3, the signal $3Y_3$ is synchronous with the time slots "3", "6", "9" - - - in which the note code $N_1$–$N_4$ is delivered as the data $KC_1$–$KC_4$.

(2) Detailed Description (FIG. 7)

The data $KC_1$–$KC_4$ from the data multiplexing circuit 16 (FIG. 1) is applied to an AND circuit 51 and a C note code conversion circuit 52 immediately before the upper keyboard selecting gate 34. The AND circuit 51 is detect the reference data "1 1 1 1" (that is, the time slot "1" in FIGS. 3 and 8), and it outputs an output "1" when all the bits of the data $KC_1$–$KC_4$ are set to "1". The output "1" of the AND circuit 51 is applied, as a timing signal $Y_1$ (FIG. 8, (d)), to the timing signal generating circuit 50 (Shown only in FIG. 6, and not shown in FIG. 7). In this connection, it should be noted that a multi-input logical circuit is illustrated according to a method that one input line is drawn on the input side thereof and the intersections of the input line and lines of signals inputted thereto are encircled.

The C note code conversion circuit 52 comprises: an AND circuit 55 which receives signals obtained by inverting the data $KC_1$ and $KC_2$ by respective inverters 53 and 54, the data $KC_3$ and $KC_4$, and the timing signal $3Y_3$; an OR circuit 56 which receives the data $KC_1$ and the output of the AND circuit 55; and an OR circuit 57 which receives the data $KC_2$ and the output of the AND circuit 55. Since the note code timing signal $3Y_3$ is generated in the time slots in which the note codes $N_1$–$N_4$ are supplied in the form of data $KC_1$–$KC_4$ as shown in the part (k) of FIG. 8, the output of the AND circuit 55 is raised to "1" when the contents of the data $KC_1$–$KC_4$ become "1 1 0 0" with the timing of supplying the note code $N_1$–$N_4$. This means that the temporary note code "1 1 0 0" of the note C is supplied. Therefore, the data $KC_1$ and $KC_2$ are convered to have "1" by applying the output "1" of the AND circuit 55 to the OR circuits 56 and 57, so that the original note code "1 1 1 1" (cf. Table 1) of the note C is supplied to the upper keyboard selecting gate 34. At the supply timing of other than the note code $N_1$–$N_4$ and when the note codes $N_1$–$N_4$ other than that of the note C are supplied, the data $KC_1$ and $KC_2$ from the data multiplexing circuit 16 are supplied thorugh the OR circuits 56 and 57 to the gate 34, as they are.

The upper keyboard selecting gate 34 comprises four AND circuits 341 through 344 corresponding to the data $KC_1$ through $KC_4$. These AND circuits 341 through 344 are enabled only the period of time during which the key data $N_1$–$N_4$, $B_1$–$B_3$ and $KO_1$ assigned to the upper keyboard exclusive channels with the aid of the timing signal $Y_{4\text{-}24}$ (FIG. 8, (e)) are supplied.

Immediately before the upper keyboard's key data are selected with the aid of the timing signal $Y_{4\text{-}24}$, the timing signal $Y_{2.3}$ (FIG. 8, (c)) is generated and it is applied to an OR circuit 351. According to this timing signal $Y_{2.3}$, the OR circuit 351 outputs a signal $H_1$ ("1") which is applied to the gate 36 to clear the contents in the first memory circuit 31. As the upper keyboard selecting gate 34 is still in disabled state, all of the outputs of the gate 34 are at "0", and these "0" outputs are inputted into the first memory circuit 31 through the gate 36, as a result of which the contents of the first memory circuit 31 are cleared.

The first memory circuit 31 comprises four 3-state/1-bit shift registers 311 through 314 juxtaposed in correspondence to the data $KC_1$ through $KC_4$. The reason why each of the shift registers 311 through 314 is of the three stages is that, as shown in FIG. 3 the key data $N_1$–$B_3$, $KO_1$ for one channel is supplied in three time slots in this example. Although on data is assigned to the first one of the three time slots, each of the shift registers 311 through 314 has three stages for coincidence of timing. In FIG. 7, shift registers (designated by reference character S/R) and 1-bit delay flip-flops (designated by reference character DQ) are driven by a clock pulse $\phi$ (not shown) which is synchronous with the supply timing of the data $KC_1$–$KC_4$.

The outputs of the last stages of the shift registers 311 through 314 are fed back to the first stages thereof through AND circuits 315 through 318, respectively. Thus, the data $B_1$–$B_3$, $KO_1$, $N_1$–$N_4$ of the time slots, which forms the maximum value key data X, is cyclically stored, in time deivision manner, in the shift registers 311 through 314.

The comparison circuit 32, receiving 4-bit binary numbers through the input terminals A and X, outputs a signal "1" to a line 59 when A=X and outputs a signal "1" to a line 60 when A>X. Accordingly, in the comparison circuit 32, comparison operation with respect to one key data is carried out in time division manner (with the key data being divided into a part $B_1$–$B_3$, $KO_1$ and a part $N_1$–$N_4$). In the higher note detection signal generating logic 35, it is decided according to the time division comparison result of the comparison circuit 32 whether each key data is large or small (higher or low), and the high note detection signal $H_1$ is produced. Upon production of the high note detection signal $H_1$ (being at "1"), AND circuits 361 through 364 forming the gate 36 are enabled, and therefore the data $KC_1$–$KC_4$ supplied at the present time are inputted into the first stages of the shift registers 311 through 314 through the AND circuits 361 through 364 and OR circuits 365 through 368, respectively. When the signal $H_1$ is at "1", it is applied through an inverter 58 to memory holding AND circuits 315 through 318 to disable the latter 315 through 318, as a result of which an old memory which is to be inputted into the first stages is cleared. When the high note detection signal $H_1$ is not produced (being at "0"), the output of the inverter 58 is at "1", and this output "1" is applied to the memory holding AND circuits 315 through 318, whereby the contents of the shift registers 311 through 314 are held.

As was dexcribed before, the weight of the block code $B_1$–$B_3$ is greater than that of the note code $N_1$–$N_4$. Accordingly, if the octave of a note is higher, then the note can be regarded as a higher note without detecting the note. Therefore, the higher note detection signal generating logic 35 is so designed as to produce the higher note detection signal $H_1$ according to the following decisions (1) and (2)

Decision (1):

When the part of block code $B_1$–$B_3$ and key-on signal $KO_1$ is of A>X, the higher note detection signal $H_1$ is produced without deciding the note code $N_1$–$N_4$.

Decision (2):

When the part of block code $B_1$–$B_3$ and key-on signal $KO_1$ is of A=X, the higher note detection signal $H_1$ is produced if the part of note code $N_1$–$N_4$ is of A>X.

In the higher note detection signal generating logic 35, the signal $Y_{4\text{-}24}$ is utilized for carrying out the above-described decision only when the upper keyboard key data is supplied to the data $KC_1$–$KC_4$. Furthermore, a block code timing signal $3Y_2$ (FIG. 8, (j)) is utilized to detect that comparison concerning the block code $B_1$–$B_3$ and the key-on signal $KO_1$ is carried out in the comparison circuit 32. These signals $3Y_2$ and $Y_{4\text{-}24}$ are applied to an AND circuit 352.

Therefore, the output of the AND circuit 352 is raised to "1" in the times slots "5", "8", "11", "14", "17" "20" and "23" in FIG. 3 or 8. This output of the AND circuit 352 is applied to AND circuits 353 and 354, whereby the AND circuits 353 and 354 are enabled in the above-described time slots (that is, when the block code $B_1$–$B_3$ and key-on data $KO_1$ concerning the upper keyboard is supplied as the data $KC_1$–$KC_4$). The output of the comparison circuit 32 concerning (A>X) is applied to the AND circuit 353 through the line 60, while the comparison output concerning (A=X) is applied to the AND circuit 354 through the line 59.

The AND circuit 353 carries out the aforementioned decision (1). That is, when the block code $B_1$–$B_3$ and key-on signal $KO_1$ supplied as the data $KC_1$–$KC_4$ is greater than that stored in the first memory circuit 31 (A X), the otu output BH of the AND circuit 353 is raised to "1". This output "1" of the AND circuit 353 is applied to the OR circuit 351, whereby the higher note detection signal $H_1$ is produced. Where the key data to be stored in the first memory circuit 31 is rewritten, it is necessary to rewrite not only the block code but also the note code $N_1$–$N_4$. Accordingly, it is necessary to produce the higher note detection signal $H_1$ over two time slots in which the block code $B_1$–$B_3$ key-on signal $KO_1$ and the note code $N_1$–$N_4$ occur as data $KC_1$–$KC_4$, respectively. For this purpose, the output "1" of the AND circuit 353 is delayed by one bit time in a delay flip-flop 355, and the delay output NH is applied to the OR circuit 351. Thus, the higher note detection signal $H_1$ has a time width of two bit times.

As the contents of the first memory circuit 31 is cleared by the signal $Y_{2.3}$ at the start of the comparison operation, initially the memory data X therein is at "0". Accordingly, the key data firstly supplied thorugh the gate 34 is first stored in the first memory circuit 31. For instance, consider the case where a key is assigned to the fourth channel (FIG. 3). In this case, the signal BH occurs in the time slot "5" as shown in the part (l) of FIG. 8, and this signal is delayed by one bit, whereby the signal NH is produced as shown in the part (m) of FIG. 8. Thus, the higher note detection signal $H_1$ is produced as shown in the part (n) of FIG. 8. When the signal BH is produced, the block code $B_1$–$B_3$ and key-on signal $KO_1$ is supplied as the data $KC_1$–$KC_4$. Therefore, the data $B_1$–$B_3$ and $KO_1$ are first inputted into the first stages of the shift registers 311 and 314. Next, when the delay signal NH is produced, the note code $N_1$–$N_4$ is supplied as the data $KC_1$–$KC_4$, and these data $N_1$–$N_4$ are inputted into the first stages of the shift registers 311 through 314 while the data $B_1$–$B_3$, $KO_1$ are shifted to the second stages thereof. Thus, one key data is stored in the shift registers 311 through 314 in time division manner.

The above-described decision (2) is carried out by the utilization of the AND circuit 354 and an AND circuit 356. The output of the AND circuit 354 is raised to "1" when the data $B_1$–$B_3$, $KO_1$ coincides with the memory data X(A=X). This output signal "1" is delayed by one bit time by a delay flip-flop 357 and is then applied to the AND circuit 356 to the other input terminal of which the signal on the line 60 is applied. When the AND circuit 356 is enabled by the output "1" of the delay flip-flop 357, the time slot of the data $KC_1$–$KC_4$ is shift to that of the note code $N_1$–$N_4$. Accordingly, when the note code $N_1$–$N_4$ of the data $KC_1$–$KC_4$ is greater than the note code of the memory data X (A>X), the signal on the line 60 is raised to "1", and the condition of the AND circuit 356 is satisfied. The output "1" of the AND circuit 356 is applied, as the higher note detection signal $H_1$, to the gate 36 through the OR circuit 351. The higher note detection signal $H_1$ outputted from the AND circuit 356 has a time width of only one bit time corresponding to the time slot of the note code $N_1$–$N_4$. The reason for this is that in the case of the decision (2) the data $B_1$–$B_3$, $KO_1$ is in coincidence with the stored contents, it is unnecessary to rewrite the memory concerning this data in the shift registers; that is, only the code note $N_1$–$N_4$ should be rewritten.

As was described above, the key data $N_1$–$N_4$, $B_1$–$B_3$, $KO_1$ supplied in the form of data $KC_1$–$KC_4$ in time division manner are successively compared with the memory data X in the first memory circuit 31 (shift registers 311 through 314), and whenever a greater (or of a higher note) key data $N_1$–$N_4$, $B_1$–$B_3$, $KO_1$ is newly applied, the key data stored in the first memory circuit 31 (shift registers 311 through 314) is rewritten into the value of the newly applied greater key data. Thus, when the signal $Y_{4\text{-}24}$ is lowered to "0", one cycle of comparison of the key data concerning all the channels of the upper keyboard (that is, comparison of all the keys depressed in the upper keyboard) is achieved. Upon achievement of the comparison (after the time slot "25" inclusive), the key data $N_1$–$B_3$, $KO_1$ of the highest note among the notes of the keys depressed in the upper keyboard has been stored in the first memory circuit 31 (shift registers 311 through 314). After the signal $Y_{4\text{-}24}$ is set to "0", the high note detection signal $H_1$ is not produced by the high note detection signal generating circuit 35, and therefore the key data of the maximum value (the highest note) is held in the shift registers 311 through 314 with the aid of the self-holding AND circuits 315 and 318. As was described above, the contents of the first memory circuit 31 is cleared by the signal $Y_{2.3}$. Therefore, the highest note comparison detection operation described above is repeated whenever the key data is supplied in time division manner (every 48 bit times in this example), whereby a new highest note key data is stored.

In the time slot for supplying the block code $B_1$–$B_3$, the most significant bit $KC_4$ is assigned to the key-on signal $KO_1$ Therefore even though the value of the block code $B_1$–$B_3$ and note code $N_1$–$N_4$ of a key is greater than those of other keys, if the key is not depressed at the present time, the key-on signal $KO_1$ thereof is at "0", and the aforementioned value is smaller than the value of the key data $N_1$–$B_3$ of a key being depressed at the present time (the signal $KO_1$ being at "1"). Thus, the key data $N_1$–$B_3$, $KO_1$ of the highest of the notes of keys being depressed is finally stored in the first memory circuit 31. However, in the case where all of the depressed keys have been released in the upper keyboard, the key data $N_1$–$B_3$, $No_1$ of the highest of the notes of the released keys (the signal $KO_1$ being at "0") is stored in the first memory circuit 31 (shift register 311 through 314).

In the second memory circuit 33, four 2-stage/1-bit shift registers 331 through 334 are provided in correspondence to the bits of the first memory circuit 31. The gate 37 comprises AND circuits 371 through 374. The outputs of the last stages of the shift registers 311 through 314 in the first memory circuit 31 are applied to one input terminals of the AND circuits 371 through 374 in the gate 37, respectively, and the key-on detection signal KOD' from the key-on detection circuit 42 is applied to the other input terminals of the AND circuits 371 through 372.

The key-on detection circuit 42 operates to detect whether or not the key-on signal $KO_1$ is included in the maximum value data stored in the first memory circuit 31 (whether or not it is at "1"). The signal $Y_{32}$ (FIG. 8, (*g*)) is used for this detection, and it is produced at the timing of the block code timing signal (FIG. 8(*j*)). That is, when the signal $Y_{32}$ is applied to the AND circuit 421 in the detection circuit 42 to enable the AND circuit 421, a signal corresponding to the key-on signal $KO_1$ has been shifted to the last stage of the shift register 314, corresponding to the fourth bit, in the first memory circuit 31. This output of the last stage of the shift register 314 is applied to the other input terminal of the AND circuit 421. Therefore, if the maximum value data X (the key data of the highest note) stored in the first memory circuit 31 is of a key being depressed, the condition of the AND circuit 421 is satisfied with the timing of the signal $Y_{32}$, and the key-on detection signal KOD is produced. This output "1" of the AND circuit 421 is applied to an OR circuit 423, a delay flip-flop 422, an OR circuit 441 in the continuous key depression detection circuit 44, and the AND circuit 45. The output of the delay flip-flop 422 is applied to the OR circuit 423. Accordingly the key-on detection signal KOD' outputted by the OR circuit 423 has a time width of two bit times (time slots 32 and 33). For the two bit times during which the signal KOD' is produced, the AND circuits 371 through 374 in the gate 37 are enabled, as a result of which the maximum value data X stored in the first memory circuit 31 is transferred into the second memory circuit 33, where it is stored. In other words, in the time slot "32" the block code $B_1$–$B_3$ and key-on signal $KO_1$ outputted by the last stages of the shift registers 311 through 314 are inputted into the first stages of the shift registers 331 through 334. In this case, the note code $N_1$–$N_4$ is in the second stages of the shift registers 311 through 314, and the first stages of the same are empty. In the next time slot "33", the note code $N_1$–$N_4$ shifted to the last stages of the shift register 311 through 314 is inputted into the first stages of the shift registers 331 through 334. In this operation, the block code $B_1$–$B_3$ and key-on signal $KO_1$ is inputted into the second stages of the shift registers 331 through 334. For the period of time the next time slot "34" to the time slot "31" in the next cycle, the key-on detection signal KOD' is not produced at all, and the AND circuits 335 through 338 are enabled through an inverter 61, so that the contents in the shift registers 331 through 334 are held.

The relations between the contents of data provided on output lines $M_1$ through $M_4$ of the last stages of the shift registers 331 through 334 and the time slots will be described with reference to FIG. 8. The block code $B_1$–$B_3$ and key-on signal $KO_1$ occurs in the time slot "34", and the note code $N_1$–$N_4$ occurs in the time slot "35". As these data are circulated every other bit, with respect to the data $B_1$–$B_3$, $KO_1$ the same data is circulated in the even-numbered time slots from the time slot "36" to the time slot "48" and from the time slot "2" to the time slot "32" (where the rewriting is effected as was described before) in the next cycle, and with respect to the data $N_1$–$N_4$ the same data is circulated in the odd-numbered time slots from the time slot "37" to the time slot "47" and from the time slot "1" to the time slot "33" (where the rewriting is effected as described above) in the next cycle.

The signals of the output lines $M_1$ through $M_4$ of the shift registers 331 through 334 are applied to AND circuit 491 through 494 in the gate 49, respectively. These AND circuit 491 through 494 are enabled by the signal $Y_{26.27}$ (FIG. 8, (*f*)) a so as to supply the maximum value data M provided on the lines $M_1$–$M_4$ to the comparison circuit 32. Before the time slots "26" and "27", in which the signal $Y_{26.27}$ is produced, occur, one cycle of comparison operation has been achieved, and therefore the truly maximum value data X has been stored in the first memory circuit 31, and this new memory data X of the first memory circuit 31 has not transferred to the second memory circuit 33 yet (that is, as it is before the time slot "32", the maximum value data M in the preceding cycle has been stored in the second memory circuit 33).

The relations between the circulation data contents of the 3-stage shift registers 311 through 314 and the time slots are similar to those shown in FIG. 3. Accordingly, in the time slot "26", the block code $B_1$–$B_3$ and key-on signal $KO_1$ of a new maximum value data X are applied to output lines $X_1$ through $X_4$ of the shift registers 311 through 314, respectively. In this even-numbered time slot "26", the block code $B_1$–$B_3$ and key-on signal $KO_1$ of the previous maximum value data M are supplied to the output lines $M_1$ through $M_4$ of the second memory circuit 33, and are applied to the input A of the comparison circuit 32 through the AND circuits 491 through 494 and the OR circuits 321 through 324, respectively. Thus, in the time slot "26", the four bits $B_1$, $B_2$, $B_3$, $KO_1$ out of the memory data X of the first memory circuit 31 are compared with those of the memory data M of the second memory circuit 33 in the comparison circuit 32. A coincidence output line 59 of the comparison circuit 32 is connected to one of the input terminals of an AND circuit 431 which is enabled by the signal $Y_{26.27}$. Accordingly, when the above-described data $B_1$–$B_3$, $KO_1$ of the memory data X coincide with those of the memory data M (A=X, or M=X), the coincidence detection signal "1" supplied to the line 59 is inputted into a 2-stage/1-bit shift register 433 through the AND circuit 431 and an OR circuit 432.

In the next time slot "27", the bits of the note code $N_1$–$N_4$ of a new maximum value data X are supplied to the output lines $X_1$ through $X_4$ of the shift registers 311 through 314. In this odd-numbered time slot "27", the bits of the note code $N_1$–$N_4$ of the previous maximum value data M are supplied to the lines $M_1$–$M_4$, respectively. Therefore, where the note code $N_1$–$N_4$ of the new maximum value data M coincides with that of the previous maximum value data M, in the time slot "27" the coincidence detection signal "1" is provided on the line 59 and is inputted into the shift register 433.

The output of the second stage of the shift register 433 is applied to one of the input terminals of an AND circuit 43 to the other input terminal of which the signal $Y_{26.27}$ is applied through an inverter 435. Therefore, the comparison result stored in the shift register 433 is self-held for the period of time which elapses from the elimination of the signal $Y_{26.27}$ until the same signal $Y_{26.27}$ is provided in the next cycle. The outputs of the two stages of the shift register 433 are applied to an AND circuit 436. When the comparison result is M=X (i.e., when the highest note is not changed), the output of the AND circuit 436 is at "1", and the coincidence signal EQ is provided. When the comparison result is M≠X (i.e., when the highest note is changed), the output of the AND circuit 436 is at "0".

Decision of Requirements 1 and 3

The above-described comparison operation has been completed before the time slot "28" occurs, and thereafter the comparison result is continuously stored. Accordingly, in the time slot "32" in which the key-on detection signal KOD is produced, it can be carried out to decide whether or not the requirements 1 and 3 are satisfied. If the highest note is changed, the coincidence signal EQ is at "0", and the AND circuit 45 is enabled through the inverter 47, and the OR circuit 46. Therefore, upon application of the key-on detection signal KOD, the output of the AND circuit 45 is raised to "1", and this output "1" is supplied, as the highest note detection pulse DP, to the pulse extending circuit 41. If the highest note is not changed, the coincidence signal EQ is at "1", and the highest note detection pulse DP is not produced even if the key-on detection signal KOD is provided.

Decision of Requirement 2

In the case where all the keys have been released, the data X stored in the first memory circuit 31 concerns the released key. Therefore, the key-on signal $KO_1$ is at "0", and the key-on detection signal KOD is not produced. Accordingly, the highest note detection pulse DP is not produced.

Decision of Requirement 4

The continuous key depression detection circuit 44 includes a delay flip-flop 442, and the key-on detection signal KOD produced by the AND circuit 421 in the time slot "32" is stored in the delay flip-flop 442 through an OR circuit 441. The output of the delay flip-flop 442 is self-held through an AND circuit 443 and the OR circuit 441. The signal $Y_{32}$ is applied through an inverter 444 to the other input terminal of the AND circuit 443. Thus, the key-on detection signal KOD stored in the delay flip-flop 442 is self-held therein until the signal $Y_{32}$ occurs in the next cycle. It is apparent from the above description that, if a key is continuously depressed in the upper keyboard (this operation will be referred to as "a continuous key depression" hereinafter, when applicable), the key-on detection signal KOD ("1") is produced in the time slot "32" every cycle. Therefore, in the continuous key depression, the output of the delay flip-flop 442 is maintained at "1" in a DC mode, and the output of the inverter 48, which is obtained by inverting this output, is at "0" at all times.

As was described above, when all the keys, which have been depressed, are released, the key-on detection signal KOD is not produced in the time slot "32" (the signal applied from the AND circuit 421 to the OR circuit 441 being at "0"). In this time slot "32" the output of the inverter 444 is set to "0", and therefore the AND circuit 443 is disabled and the memory of "continuous key depression" is cleared. Accordingly, thereafter the output of the flip-flop 442 is maintained at "0", and the output of the inverter 48 is set to "1", whereby the AND circuit 45 is enabled through the OR circuit 46. If the key-on detection signal KOD is not produced, then a signal KOD' is not provided, and accordingly, the maximum value data M in the second memory circuit 33 is not cleared, that is, it M is maintained after all the keys have been released.

When keys are depressed again, the key data X of the highest of the notes of the keys thus depressed is stored in the first memory circuit 31, and therefore the key-on detection signal KOD is produced in the time slot "32" of generating the signal $Y_{32}$. The key-on detection signal KOD in this case is shown in the part (o) of FIG. 8. At the same time, a signal "1" is inputted into the delay flip-flop 442 through the AND circuit 421 and the OR circuit 441. In the time slot "32" one bit time after this, the output of the delay flip-flop 442 is raised to "1" from "0". The output of the inverter 48 obtained by inverting this output "1" is lowered to "0" from "1" as indicated in the part (p) of FIG. 8. As is apparent from the parts (o) and (p) of FIG. 8, in the time slot "32" the condition of the AND circuit 45 is satisfied and the highest note detection pulse DP is produced (see part (q) of FIG. 8).

In the case where the highest note of the notes of the keys newly depressed (being stored in the first memory circuit 31) is different from the previous (immediately before the key release) highest note (being stored in the second memory circuit 33), the coincidence signal EQ is not provided and the output of the inverter 47 is set to "1". Accordingly, the condition of the AND circuit 45 is satisfied also by this output "1" of the inverter 47. However, when the new highest note is equal to the previous highest note, the coincidence signal EQ is produced and the output of the inverter 47 is maintained at "0". Therefore, in this case, the signal from the delay flip-flop 442 in the continuous key depression detection circuit 44 is effectively utilized to produce the highest note detection pulse DP.

Examples of the states that the highest note detection pulse DP is produced or not produced according to the above-described requirements 1 thorugh 4 will be described with reference to FIGS. 9(*a*)-(*c*).

Figure 9:
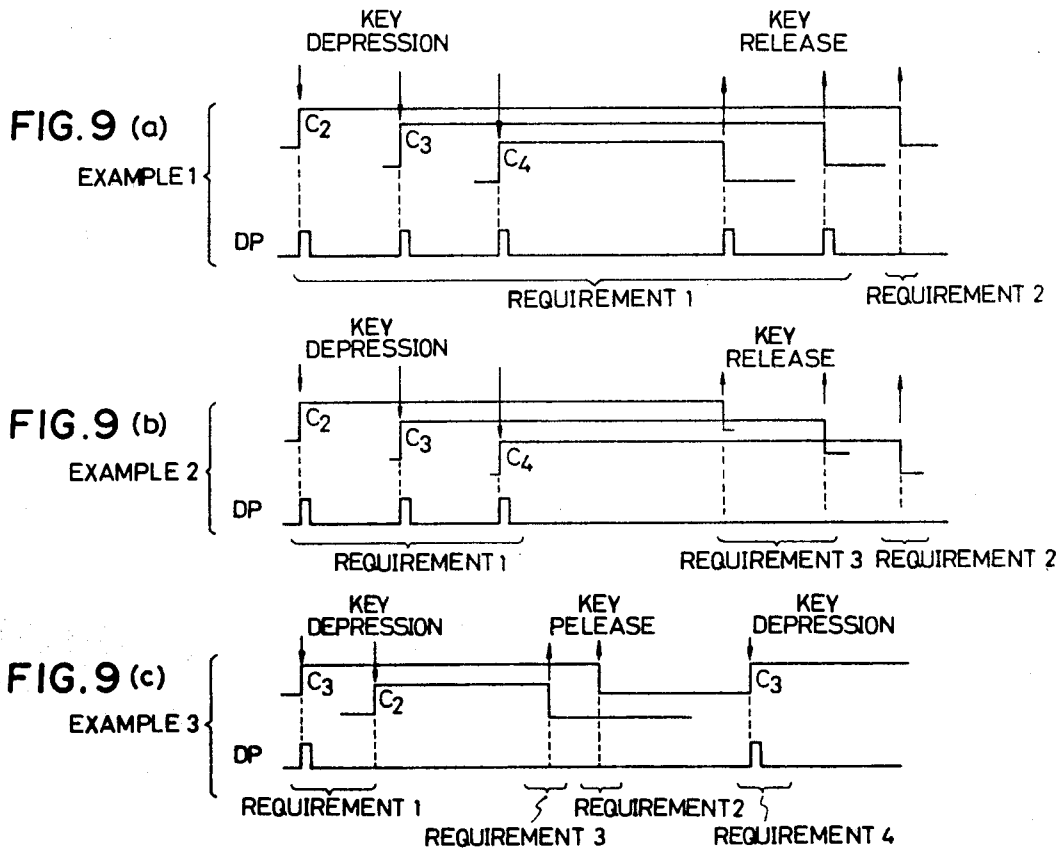
FIGS. 9(*a*)–(*c*) are diagram for a description of the highest note selecting operation of the single data selecting circuit shown in FIGS. 6 and 7 with reference to various key operations.

In Example 1 shown in FIG. 9(*a*), the keys $C_2$, $C_3$ and $C_4$ are depressed in the stated order, and the keys are released in the reversed order ($C_4$, $C_3$, $C_2$). As the keys $C_2$, $C_3$ and $C_4$ are depressed in the state order, the highest note is changed, and therefore the pulse DP is produced for every key depression. When the key $C_4$ is released, the highest note is $C_3$, and thereafter when the key $C_3$ is released, the highest note is $C_2$. Therefore, in this case, the pulse DP is produced every key release. The generation of the pulse DP according to the requirement 1 is as described above.

When the last key $C_2$ is released, the pulse DP is not produced according to the requirement 2 because all the keys have been released.

In Example 2 shown in FIG. 9(*b*) the keys $C_2$, $C_3$ and $C_4$ are depressed in the stated order, and they are released in the same order ($C_2$, $C_3$ and $C_4$). According to the requirement 1 the pulse DP is produced for every key depression ($C_2$, $C_3$, $C_4$). Even if the keys $C_2$ and $C_3$ are released, the highest note is maintained unchanged in this Example 2, and therefore the pulse DP is not produced according to the requirement 3.

In Example 3 shown in FIG. 9(*c*) the keys $C_3$ and $C_2$ are depressed in the described order, and then the keys are released in the reversed order ($C_2$ and $C_3$), and thereafter (after all the keys have been released) the key $C_3$ is produced; however, when the key $C_2$ is subsequently depressed, the pulse DP is not provided, because the highest note $C_3$ is not changed. When the key $C_2$ is released thereafter, the pulse DP is not produced fro the same reason. After the last key $C_3$ is released, this last highest note $C_3$ is stored in the second memory circuit 33. When the same key $C_3$ is thereafter depressed again, the pulse DP is produced according to the requirement 4.

Referring back to FIG. 7, among the key data of the highest note, the block code $B_1$-$B_3$ and key-on signal $KO_1$, or the four bits, and the note code $N_1$-$N_4$, or the four bits, are repeatedly provided in time division manner on the output lines $M_1$ through $M_4$ of the shift registers 331 through 334 in the second memory circuit 33, respectively. The latch circuit 38 operates to latch, in a parallel mode, the block code $B_1$-$B_3$ and the note code $N_1$-$N_4$ and to convert them into sustained signals. The latch circuit 8 has seven latch positions corresponding to the seven bits of the note code $N_1$-$N_4$ and block code $B_1$-$B_3$ to latch the input data $N_1$-$N_4$, $B_1$-$B_3$ with the timing of generating the strobing signal $Y_3$ (FIG. 3, (*d*)).

As is clear from the above description with reference to the second memory circuit 33, the note code $N_1$-$N_4$ is supplied to the output lines $M_1$ through $M_4$ thereof. Accordingly, in the time slot "3" during which the strobing signal $Y_3$ is generated, among the key data of the highest note, the note code $N_1$-$N_4$ is supplied to the output lines $M_1$ through $M_4$ of the shift registers 331 through 334 in the second memory circuit 33, and the data $N_1$ through $N_4$ are applied to the data input terminals of the respective latch positions in the latch circuit 38. In the time slot "2" one bit time before this, among the key data of the highest note the block code $B_1$-$B_3$ is supplied to the output lines $M_1$ through $M_3$, and the data $B_1$ through $B_3$ are delayed by one bit time by delay flop-flops 381, 382 and 383 respectively. Thus, in the time slot "3", the bits of the block code $B_1$-$B_3$ from the respective delay flip-flops 381 through 383 are applied to the data input terminals of the respective latch positions provided for the block code $B_1$-$B_3$ in the latch circuit 38. Thus, in the slot time during which the signal $Y_3$ is generated, the note code $N_1$-$N_4$ and the block code $B_1$-$B_3$ forming the key data of the highest note can be latched in a parallel mode by the latch circuit. The key-on signal $KO_1$ stored in the fourth-bit shift register 334 is no longer required, and therefore it is not latched by the latch circuit 38. That is to say that the above-described highest note detection pulse DP (more specifically the solo effect switching signal CS produced from the pulse DP) is employed as the key-on signal controlling the tone production of the highest note, in this case.

Pulse Extending Circuit 41

The pulse extending circuit 41 has a function such as that of a one-shot circuit. In the pulse extending circuit 41, the duration time of the highest note detection pulse DP applied thereto is extended to a predetermined time width to produce the solo effect tone switching signal CS. For instance, the duration time of the order of 1 $\mu$s of the pulse DP is increased to about 3 ms, thereby to obtain the solo effect tone switching signal CS. An ordinary one-shot circuit may be employed as the pulse extending circuit 41; however, a circuit as shown in FIG. 10 is suitable for integrated circuits.

Figure 10:
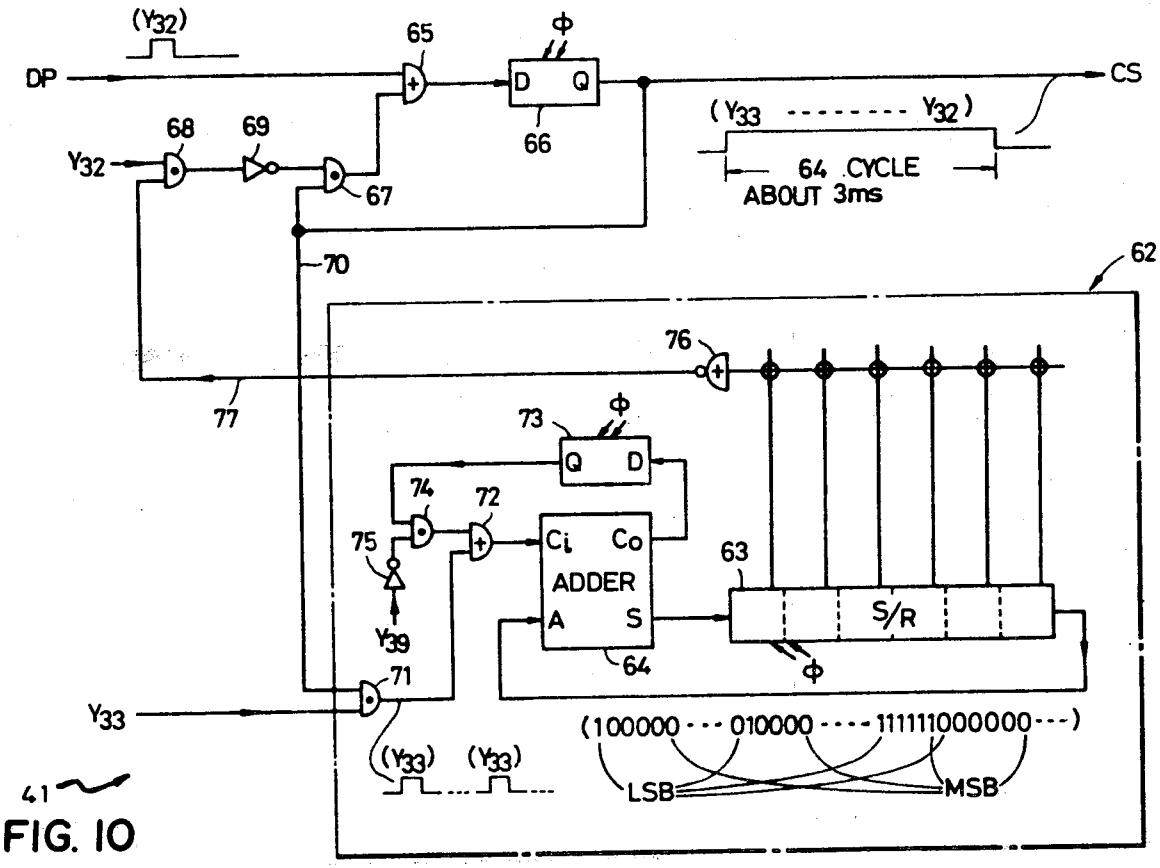
FIG. 10 is a block diagram illustrating one example of a pulse extending circuit shown in FIGS. 6 and 7.

In the pulse extending circuit 41 shown in FIG. 10, reference numeral 62 designates a circuit in which the signal $Y_{33}$ (FIG. 8(*h*)), which is generated as a count pulse with a period of 48 bit times (48 $\mu$s), is counted. That is, the circuit 62 carries out counting operation actually. More specifically, the circuit 62 includes a 6-stage shift register 63 and a 1-bit half-adder 64 to perform addition of base-$2^6$ (=64). The reason why the shift register 63 instead of an ordinary binary counter is employed in this example is that, in the case where the circuit is manufactured in the form of an integrated circuit, the area occupied by the shift register is smaller than that occupied by the counter. This shift register 63 is driven by the clock pulse $\phi$ having a period of one bit time, similarly as in the other parts of this electronic musical instrument.

In the time slot "32" during which the signal $Y_{32}$ is generated, the highest note detection pulse DP from the AND circuit 45 (FIG. 7) is applied through an OR circuit 65 to a delay flip-flop 66. Accordingly, in the next time slot "33", the output of the delay flip-flop 66 is raised to "1". This output "1" of the delay flip-flop 66 is self-held through an AND circuit 67 and the OR circuit 66. The output of an AND circuit 68 is applied through an inverter 69 to the other input terminal of the AND circuit 67, and the signal $Y_{32}$ is applied to the AND circuit 68. Accordingly, for the period of time of from the time slot "33" to the time slot "31" in the next cycle, the output of the AND circuit 68 is positively maintained at "0", and as this output "0" is applied through the inverter 69 to the AND circuit 67, the latter 67 is enabled.

The output of the delay flip-flop 66 is applied through a line 70 to one of the input terminals of an AND circuit 71, to the other input terminal of which the counting signal $Y_{33}$ is applied. Therefore, for a predetermined period of time after the generation of the highest note detection pulse DP, the output of the AND circuit 71 is raised to "1" whenever the signal $Y_{33}$ is provided (repeatedly with a period of 48 μs). This output "1" of the AND circuit 71 is applied through an OR circuit 72 to an input terminal Ci of the adder 64. In the signal $Y_{33}$ generating time slot "33", the signal "1" from the AND circuit 71 is added only to the data of the least significant bit of six bits held in the shift register 63. More specifically, a series addition circuit is formed in which the output of the last stage of the shift register 63 is applied to an input terminal A of the adder 64, the output S of the adder 64 is applied to the first stage of the shift register 63, the carry output Co of the adder 64 is returned to the input terminal Ci one bit time later through a delay flip-flop 73, and AND circuit 74 and the OR circuit 72, so that one (1) is added to the 6-bit data held in the shift register 63. The signal $Y_{39}$ (FIG. 8, (i)) is applied through an inverter 75 to the other input terminal of the AND circuit 74. The reason for this is that, as the series addition to the 6-bit data is carried out during six bit times, the carry output Co should be supplied to the input terminal Ci for the period of time of from the time slot "33" to the time slot "38" which occurs at the sixth bit time from the time slot "33" (inclusive), and it is unnecessary to return the carry output Co to the input terminal Ci in the time slot "39" during which the signal $Y_{39}$ is generated. Accordingly, for the period of time of from the time slot "39" to the time slot "32" in the next cycle, no addition is performed, and the 6-bit addition result is merely circulated. As one cycle is 48 bit times and the number of stages of the shift register 63 is six, the six-bit data makes just eight circulations. Thus, during the addition period of from the time slot "33" to the time slot "38" in each cycle, the data at the same bit position is supplied from the last stage of the shift register 63 to the adder 64 in the same time slot.

Thus, the data held in the shift register 63 is increased every cycle (48 μs) as "0 0 0 0 0 1"→"0 0 0 0 1 0"→. . . . The output of the stages of the shift register 63 are applied to a NOR circuit 76, the output of which is applied through an overflow detection line 77 to the AND circuit 68. Accordingly, when the circuit 62 is placed in count state, a signal "1" appears in any one of the stages of the shift register 63, and therefore the output of the NOR circuit 76 is continuously maintained at "0". Accordingly, the AND circuit 68 also outputs a signal "0" continuously (also in the time slot "32"), and the AND circuit 67 is continuously enabled. Thus, after the supply of the pulse DP (more specifically, from the next time slot "33"), the output of the delay flip-flop 66 is continuously maintained at "1". This continuous output signal "1" of the delay flip-flop 66 is provided, as the solo effect tone switching siganal CS, by the pulse extending circuit 41.

In the 64th cycle (or when 64 signals $Y_{33}$ have been generated) after the circuit 62 is placed in count state, the 6-bit addition data overflows, as a result of which the data held in all the stages of the shift register 63 are set to "0". As a result, the output of the NOR circuit 76 is raised to "1", and this output "1" is applied through the overflow detection line 77 to the AND circuit 68, whereby the latter 68 is enabled. Therefore, when the signal $Y_{32}$ is generated in the time slot "32" the output of the AND circuit 68 is raised to "1", and as this output "1" is applied thorugh the inverter 67 to the self-holding AND circuit 67, the latter 67 is disabled. Thus, in the next time slot "33", the output of the delay flip-flop 66, that is, the signal CS is set to "0".

As is apparent from the above description, the signal CS is maintained at "1" for $64\times48$ μs$\approx$3 ms. Thus, the puse DP having a duration time of 1 μs has been extended to about 3 ms. Of course, the time width 3 ms of the solo effect tone switching signal CS is only one example; the invention is not limited thereto or thereby.

The sole effect tone switching signal CS is applied to the envelope generator 22 (FIG. 1) to drive the latter 22 so that the envelope shape voltage signal EV is produced. In response to the production of the envelope shape voltage signal EV, the cut-off frequency of the voltage controlled filter 20 is controlled, so that at the rise of the changed highest note's tone its tone color is varied, as a result of which it is possible to make a strong impression that the highest note has been changed. That is, in the tone generator section 13 shown in FIG. 5, the tone source signal of the highest note selected by the single data selecting circuit 23 is switched by the envelope shape voltage signals E8′, E4′ and E2′ in the tone keyers 29-8′, 29-4′ and 29-2′. The signals E8′, E4′ and E2′ are generated by the envelope generator 19 according to whether or not a key is depressed in the upper keyboard and irrespective of the change of the highest note. Therefore, as long as a key is continuously depressed, the envelope shape voltage signals E8′, E4′ and E2′ are maintained unchanged even if the highest note is changed. Accordingly, the tone source signal of the highest note is continuously produced by the solo performance tone generator section 13. Thus, even though the highest note is changed during the continuous key depression, the tone pitch of the musical tone signal MT (FIG. 1) may be changed, but its amplitude envelope is maintained unchanged. It is advantageous in order to make a strong impression that the highest note, or the solo effect tone, has been changed, to control the tone color with the envelope waveform voltage signal EV at the rise of the changed new highest note (at the start of tone production).

If the analog gate 40 is provided as indicated by the broken line in FIG. 1 so that the amplification factor of the analog gate 40 is controlled by the envelope shape voltage signal EV, then the tone production of the musical note signal can be controlled. That is, the musical tone signal of the highest not, or the solo effect tone, which is produced by the solo performance tone generator asection 13 and is subjected to tone color control in the voltage controlled filter 20, is produced as a tone with the timing of production of the highest note detection pulse DP (that is, the solo effect tone switching signal CS). In this case, the highest note, or the solo effect tone, is produced as a tone intermittently only when it is changed.

In the example described above, the highest of the notes of keys depressed in the keyboard is selected and produced as the solo effect tone; however, the note selected can be the lowest note. In this case, the selection of the lowest note may be achieved by designing the arrangement of the comparison circuit 32 shown in FIGS. 6 and 7 so as to detect (A<X) and (A=X).

In the example described above, the key data $N_1$–$N_4$, $B_1$–$B_3$, $KO_1$ supplied in time division manner by the tone production assigning circuit 15 respectively for the channels are further multiplexed in time division manner into 4-bit data $KC_1$–$KC_4$ in the data multiplexing circuit 16. However, in view of the subject matter of this invention, the data multiplexing circuit 16 is not always necessary; that is, the data multiplexing circuit 16 may be eliminated, and instead the key data $N_1$–$N_4$, $B_1$–$B_3$, $KO_1$ supplied in time division manner by the tone production assigning circuit 15, being assigned to the channel times, may be supplied, as they are, to the signle data selecting circuit 23. In this case, although the number of bits in the comparison circuit 32, the first memory circuit 31 and the second memory circuit 33 is increased, the number of stages in the shift registers 311 through 314 and 331 through 334 therein is decreased. Since the key data for one channel is not subjected to time division, the timing control can be achieved more simply than that in FIG. 7.

Furthermore, in the above-described example, the highest or lowest of the notes of keys depressed in one keyboard (the upper keyboard) is detected; however, it should be noted that the invention is not limited thereto or thereby; that is, the highest or lowest of the notes of keys depressed through out a plurality of keyboards may be detected to produce a single tone. In this case, an interesting solo performance effect can be expected, merely by slightly modifying the arrangement of a part of the upper keyboard selecting gate 34 and the relevant parts in FIGS. 6 and 7 according to the kinds of keyboards used.

In addition, in the above-described example, the key-on signal $KO_1$ occupies the most significant bit of the key data to perform the comparison operation for detecting the highest note. Accordingly, the weight of the key data of a key released is less than that of the key data of a key being depressed, even if the key released is of a higher note. Thus, the key data of a depressed key takes precedence over the key data of a released key in detecting the highest note, although no particular priority circuit is provided, which leads to a simplification of the circuitry.

In the case where the single data selecting circuit 23 is so arranged as to detect the lowest note as implied above four paragraphs before, the single data selecting circuit 23 is modified so that the comparison operation of the comparison circuit 32 detects (A<X). Accordingly, in this case it is necessary to allow the depressed key's key data to take precedence over the released key's key data. This requirement can be accomplished by the following method; The key-on signal $KO_1$ is allowed to occupy the most significant bit of the key data similarly as in the above-described example, and the logical level of this key-on signal $KO_1$ is inverted (that is, the key depression being "0", the key release being "1") and is then applied to the comparison circuit 32.

In the example described above, the time of one cycle for supplying the key data in time division manner is constant (48 bit times); however, the technical concept of this invention may be applied to the case where the time of one cycle is caried according to the number of keys depressed.

What is claimed is:

1. A solo performance system for a keyboard electronic musical instrument of the type in which digital key codes representing operated keys are repetitively supplied in time division multiplex fashion to a tone generator, the numerical values of said key codes being ordered in accordance with the tone pitches of the notes selected by operation of the corresponding keys, a portion of each key code indicating the depressed or released state of the corresponding key, said system comprising:

first means for ascertaining, during each time division multiplex cycle, which of the supplied key codes has the highest (or lowest) numerical value pitch, and for making available said ascertained key code for use by a tone generator in said instrument, second means, cooperating with said first means, for comparing said key code ascertained by said first means during the current time division multiplex cycle with the key code ascertained during the prior cycle and for producing a signal indicative of the result of said comparison, and logic means, cooperating with said first and second means and responsive to said comparison-indicative signal and to the state-indicating portion of the key code ascertained by said first means during each time division multiplex cycle, for selectively providing to said instrument a solo effect tone switching signal indicating that a new note of highest pitch has been selected.

2. A solo performance system as defined in claim 1 further comprising:

a solo performance tone generator, cooperating with said first means and said logic means, that produces a solo musical tone having a pitch specified by said made-available ascertained key code, said tone generator having an envelope generator which establishes the amplitude envelope of said solo musical tone in response to said solo effect tone switching signal.

3. A solo performance system for a keyboard electronic musical instrument of the type in which digital key codes representing operated keys are repetitively supplied in time division multiplex fashion to a tone generator, the numerical values of said key codes being ordered in accordance with the tone pitches of the notes selected by operation of the corresponding keys, each key code including an indication of the depressed or released state of the corresponding key, said system comprising:

a first memory, selective storage means, operative during each repetitive supply of said key codes, for causing storage into said first memory of the single supplied key code having a preestablished numerical value relationship to all other supplied key codes, a second memory, and transfer gate means, operative after the end of each repetitive supply of said key codes, for transferring the key code then stored in said first memory into said second memory if said then stored key code indicates that the corresponding key is depressed, the key code in said second memory being usable by said instrument to produce a corresponding solo tone.

4. A solo performance system as defined in claim 3 further comprising:

coincidence detection means, operative between the end of each repetitive supply of said key codes and the operation of said transfer gate means, for comparing the numerical values of the key code then stored in said first memory with the numerical value of the key code last stored in said second memory, and for providing an "equal" signal if they are equal, said transfer gate means providing a "key-on" signal in the event that said key code then stored in said first memory indicates that the corresponding key is depressed, and detection pulse logic means, cooperating with said transfer gate means and said coincidence detection means, for providing a solo effect tone switching signal in response to certain states of said "equal" signal and said "key-on" signal.

5. A solo performance system as defined in claim 4 wherein said detection pulse logic means provides said tone switching signal when said "equal" signal is false and said "key-on" signal is true; and does not provide said tone switching signal when either (a) said "equal" signal is false and said "key-on" signal is false, or (b) said "equal" signal is true and said "key-on" signal is true.

6. A solo performance system as defined in claim 4 wherein said detection pulse logic means further comprises:

continuous key depression detection means, responsive to a false "key-on" signal, for temporarily storing a signal indicating that all keys have been released, and further circuitry, cooperating with said continuous key depression detection means, for providing said tone switching signal when said "key-on" signal next goes true during the time of temporary storage of said signal indicating that all keys have been released.

7. A solo performance system as defined in claim 3 wherein said preestablished numerical value relationship is that said single supplied key code has the highest numerical value as compared to all other supplied key codes.

8. A solo performance system as defined in claim 3 wherein said preestablished numerical value relationship is that said single supplied key code has the lowest numerical value as compared to all other supplied key codes.

9. An electronic musical instrument comprising:

means for repeatedly supplying, during repetitive cycles and in time division manner, key data concerning keys operated in a keyboard, the numerical value of said key data being ordered in accordance with the tone pitch of a note selected by the operated key;

a comparison circuit for successively comparing, during each cycle, said key data supplied in time division manner with one another to provide comparison results;

a first memory for storing key data having a specific order relationship with the prior contents of said first memory by successively rewriting the contents of said first memory according to said comparison results;

means for clearing the key data stored in said first memory during a period of time between the end of each cycle of supplying said key data in time division manner and the start of a following cycle;

a second memory, and control means for reading out said key data stored in said first memory and storing said read-out key data in said second memory during an intermediate period of time between the end of said each cycle and clearing of said key data stored in said first memory; and means for producing a musical tone having a tone pitch corresponding to said key data stored in said second memory.

10. An electronic musical instrument as defined in claim 9, in which said key data consists of a plural-bit digital signal, the most significant bit thereof including a signal representative of depression or release of the key to which said key data concerns, the remaining bits representing the note of said key, the value of said remaining bits corresponding to the tone pitch of said note, and in said comparison circuit values of all bits of said key data are compared with one another so that key data of the note of a depressed key is stored in said first memory in precedence to key data of the note of a released key.

11. An electronic musical instrument as defined in claim 9 wherein each key data indicates the depressed or released state of the key to which said key data concerns, and wherein said control means further comprises:

circuitry, operative during said intermediate period, for comparing the key data contents of said first memory at the end of said each cycle with the prior contents of said second memory and for generating an "equivalence" signal indicative of the result of said comparison, key-on detection circuitry, for determining from said key data contents of said first memory at the end of said each cycle whether said contents represents a depressed key, and for providing a key-on detect signal in response to such determination, and logic means for providing a highest note detection pulse in response to preselected states of said "equivalence" signal and said key-on detect signal.

12. An electronic musical instrument as defined in claim 10 wherein said control means comprises:

key-on detection circuitry, cooperatively connected to said first memory, for providing a key-on detection signal when the key data contained in said first memory at the end of said each cycle includes a signal representative of the depression of the key to which said data concerns, said storing of said read-out key data in said second memory being enabled by occurrence of said key-on detection signal.

* * * * *